US010155405B2

(12) United States Patent
Kyoso

(10) Patent No.: US 10,155,405 B2
(45) Date of Patent: Dec. 18, 2018

(54) INKJET PRINT DEVICE AND INKJET HEAD EJECTION PERFORMANCE EVALUATION METHOD

(71) Applicant: FUJIFILM Corporation, Tokyo (JP)

(72) Inventor: Tadashi Kyoso, Ashigarakami-gun, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/340,963

(22) Filed: Nov. 1, 2016

(65) Prior Publication Data

US 2017/0120647 A1 May 4, 2017

(30) Foreign Application Priority Data

Nov. 2, 2015 (JP) ..... 2015-215517

(51) Int. Cl.

| | |
|---|---|
| ***B41J 29/393*** | (2006.01) |
| ***B41J 2/165*** | (2006.01) |
| ***B41J 2/21*** | (2006.01) |
| ***B41J 2/045*** | (2006.01) |

(52) U.S. Cl.

CPC ..... *B41J 29/393* (2013.01); *B41J 2/04505* (2013.01); *B41J 2/04586* (2013.01); *B41J 2/16579* (2013.01); *B41J 2/16585* (2013.01); *B41J 2/2142* (2013.01); *B41J 2/2146* (2013.01)

(58) Field of Classification Search

None

See application file for complete search history.

(56) References Cited

U.S. PATENT DOCUMENTS

2004/0012649 A1* 1/2004 Eguchi ..... B41J 2/04505 347/20
2006/0081145 A1* 4/2006 Kim ..... B41J 19/202 101/484

(Continued)

FOREIGN PATENT DOCUMENTS

JP 2008-012701 1/2008
JP 2014-226911 12/2014

OTHER PUBLICATIONS

"Search Report of European Counterpart Application", dated Mar. 20, 2017, p. 1-p. 5.

*Primary Examiner* — Matthew Luu
*Assistant Examiner* — Tracey McMillion
(74) *Attorney, Agent, or Firm* — JCIPRNET

(57) ABSTRACT

An inkjet head ejection performance evaluation method includes: printing a test pattern for examining an ejection condition for each nozzle by an inkjet head and reading the test pattern by an image reading device; measuring a first depositing position for each nozzle from a read image to calculate an angle deviation amount of the inkjet head based on the first depositing position and pattern information; calculating at least one of a second depositing position and second deposit displacement amount in which an influence due to angle deviation caused is eliminated; calculating a moving amount caused by rotation of the angle deviation amount from a reference position of the nozzle at a reference attaching angle up to a current nozzle position; and calculating, by using these calculation results, at least one of a distance between the adjacent pixels and a third deposit displacement amount including the influence.

20 Claims, 18 Drawing Sheets

(56) References Cited

U.S. PATENT DOCUMENTS

2006/0221125 A1* 10/2006 Konno ..... B41J 2/1433
347/40
2008/0291510 A1* 11/2008 Iwai ..... H04N 1/0473
358/474
2012/0250040 A1* 10/2012 Yamazaki ..... B41J 2/2135
358/1.8

* cited by examiner

INKJET PRINT DEVICE AND INKJET HEAD EJECTION PERFORMANCE EVALUATION METHOD

CROSS-REFERENCE TO RELATED APPLICATIONS

The present application claims priority under 35 U.S.C. § 119 to Japanese Patent Application No. 2015-215517, filed on Nov. 2, 2015. The above application is hereby expressly incorporated by reference, in its entirety, into the present application.

BACKGROUND OF THE INVENTION

Field of the Invention

The present invention relates to an inkjet print device and an inkjet head ejection performance evaluation method, and particularly relates to an inkjet print device using an inkjet head which has a plurality of nozzles arrayed in a matrix thereon and a technology for evaluating ejection performance of the inkjet head.

Description of the Related Art

Japanese Patent Application Laid-Open No. 2008-012701 has described an inkjet print device which includes an elongated liquid droplets ejection head having a plurality liquid droplets ejection units arrayed in a width direction of a paper sheet, each liquid droplets ejection unit having a plurality of nozzles arrayed in a matrix and aligned in a row in a conveying direction of a paper sheet. Japanese Patent Application Laid-Open No. 2008-012701 has proposed a method for adjusting an attaching angle of a liquid droplets ejection head by detecting a displacement amount of the attaching angle in a rotation direction along a recording surface of a paper sheet for each liquid droplets ejection unit.

According to Japanese Patent Application Laid-Open No. 2008-012701, a line pattern is printed by the liquid droplets ejection head, a printed result thereof is read by an optical sensor to obtain read image data, from which a gap between adjacent lines is calculated, and the displacement amount of the attaching angle for each liquid droplets ejection unit is calculated based on the calculated line gap (claim 7, paragraph 0044 in Japanese Patent Application Laid-Open No. 2008-012701). The "paper sheet" in Japanese Patent Application Laid-Open No. 2008-012701 is a term corresponding to a "recording medium" herein, and the "liquid droplets ejection unit" in Japanese Patent Application Laid-Open No. 2008-012701 is a term corresponding to "inkjet head" herein.

Japanese Patent Application Laid-Open No. 2014-226911 has described a configuration in which a linear pattern formed by an inkjet head on a paper sheet is read by a scanner to obtain information, from which positional information on each linear pattern is obtained to calculate an inclination angle of the head (claim 1, paragraphs 0046-0047 and 0049-0055 in Japanese Patent Application Laid-Open No. 2014-226911). The "linear pattern in" Japanese Patent Application Laid-Open No. 2014-226911 is a term corresponding to the "line pattern" in Japanese Patent Application Laid-Open No. 2008-012701.

SUMMARY OF THE INVENTION

The inkjet head having a plurality of nozzles varies in ejection characteristics of the individual nozzles, and its ejection condition changes depending on an ink thickened within the nozzle or a foreign matter adhered. For example, if the foreign matter is adhered to or around the nozzle, liquid droplets ejected from the nozzle are affected to involve variations in an ejection direction, which makes it difficult to deposit the liquid droplets at a predetermined position on a recording medium. As a result, an output image quality by way of printing is lowered.

For this reason, it is preferable that the inkjet print device evaluates ejection performance of the inkjet head before performing a printing job or during performing the printing job to carry out a correction process or maintenance depending on an evaluation result in order to keep a good print quality.

There has been known, as one of methods for evaluating the ejection performance of the inkjet head, a technology in which a line pattern called a nozzle state check pattern is printed, the printed nozzle state check pattern is read by an image reading apparatus such a scanner and the like, and a deposit displacement for each nozzle is detected from the resultant read image. The "deposit displacement" is equivalent to "displacement of a dot forming position," meaning displacement of a position where a dot actually is formed from an ideal position where the dot is to be formed. The "ideal position where the dot is to be formed" is a design targeted position and refers to a dot forming position in a state where no error is assumed. Various factors cause the displacement of a dot forming position, for example, a curve of the ejection direction of each nozzle causes the displacement. The dot forming position is equivalent to a depositing position. Additionally, measuring the depositing position of each nozzle corresponds to measuring the ejection direction of each nozzle.

However, this method has a problem that in a case where in a configuration using the inkjet head having a plurality of nozzles arrayed in a matrix thereon, the inkjet head is attached with having an angle deviation in the rotation direction along the recording surface of the recording medium, the deposit displacement of each nozzle cannot be accurately evaluated.

The technologies described in Japanese Patent Application Laid-Open No. 2008-012701 and Japanese Patent Application Laid-Open No. 2014-226911, although the displacement amount of the attaching angle for the inkjet head is calculated from the printed result of the line pattern, the calculated displacement amount is used to adjust the attaching angle for the inkjet head (attitude adjustment). The technologies described in Japanese Patent Application Laid-Open No. 2008-012701 and Japanese Patent Application Laid-Open No. 2014-226911 cannot deal with the above problem.

Particularly, the inkjet print device is required to give a stable output of printing under a continuous operation from the view point of improving productivity of a printed matter. For this reason, a case where an ejection defective nozzle is detected when the ejection performance of the inkjet head of the inkjet print device in operation is evaluated needs to be dealt with by the correction process, head cleaning or the like. Regarding this point, the technologies described in Japanese Patent Application Laid-Open No. 2008-012701 and Japanese Patent Application Laid-Open No. 2014-226911 are difficult to apply to evaluating the ejection performance of the inkjet head of the inkjet print device in operation.

The present invention has been made in consideration such a circumstance, and has an object to provide an inkjet print device and inkjet head ejection performance evaluation method capable of accurately evaluating an ejection condition of each nozzle even in a case where an inkjet head is attached with having an angle deviation in a rotation direction along a recording surface of a recording medium.

A solution to solve the problems is as described below.

An inkjet print device according to a first aspect includes an inkjet head having therein a plurality of nozzles arrayed in a matrix, a test pattern output control device which controls the inkjet head to record a test pattern for examining an ejection condition for each of the nozzles on a recording medium, an image reading device which optically reads an image of the test pattern recorded on the recording medium, a first calculation device which measures a first depositing position for each of the nozzles from the read image of the test pattern read by the image reading device, an angle deviation amount calculating device which calculates an angle deviation amount of the inkjet head with respect to a reference attaching angle based on the first depositing position measured by the first calculation device and pattern information of the test pattern, a second calculation device which calculates at least one of a second depositing position for each of the nozzles and a second deposit displacement amount for each of the nozzles in which an influence due to angle deviation caused by the angle deviation amount is eliminated from at least one of the first depositing position for each of the nozzles measured by the first calculation device and a first deposit displacement amount for each of the nozzles calculated based on data of the first depositing position, a third calculation device which calculates a moving amount caused by rotation of the angle deviation amount from a reference position of the nozzle at the reference attaching angle up to a current nozzle position based on the angle deviation amount calculated by the angle deviation amount calculating device, and a fourth calculation device which uses calculation results by the second calculation device and the third calculation device to calculate at least one of a distance between adjacent pixels including the influence due to the angle deviation and a third deposit displacement amount for each of the nozzles including the influence due to the angle deviation.

According to the first aspect, there can be calculated the distance between the adjacent pixels or the deposit displacement amount for each nozzle (third deposit displacement amount) accurately including the influence due to the angle deviation even in a case where the inkjet head is attached with having the angle deviation in the rotation direction along the recording surface of the recording medium. This allows the ejection condition of each nozzle to be correctly evaluated.

A second aspect may be configured such that in the inkjet print device according to the first aspect, the fourth calculation device is configured to calculate the distance between the adjacent pixels including the influence due to the angle deviation, and the inkjet print device further includes an ejection disabling processing device which disables a defective nozzle from ejection, for which the distance between the adjacent pixels calculated by the fourth calculation device is out of a prescribed acceptable range, and a correction processing device which performs image correction to supplement an image defection which is involved by disabling the defective nozzle from ejection by use of near nozzles around the defective nozzle.

A third aspect may be configured such that in the inkjet print device according to the first aspect, the fourth calculation device is configured to calculate the third deposit displacement amount of the nozzle including the influence due to the angle deviation, and the inkjet print device further includes an ejection disabling processing device which disables a defective nozzle from ejection, the third deposit displacement amount of the defective nozzle calculated by the fourth calculation device exceeding a threshold, and a correction processing device which performs image correction to supplement an image defection which is involved by disabling the defective nozzle from ejection by use of near nozzles around the defective nozzle.

A fourth aspect may be configured such that the inkjet print device according to any one of the first aspect to the third aspect includes a relative moving device which causes relative movement between the inkjet head and the recording medium, in which the inkjet head has a nozzle array in a matrix in which the plurality of nozzles are arrayed in three or more alignments in a first direction that is a direction of the relative movement.

A fifth aspect may be configured such that in the inkjet print device according to the fourth aspect, the test pattern is a line pattern for recording a line for each of the nozzles in the first direction, and is divided into two or more line groups to be recorded on the recording medium, and the inkjet print device further includes a test pattern generating device which generates data of the test pattern, in which the test pattern output control device controls ejection from the inkjet head based on the data of the test pattern.

A sixth aspect may be configured such that in the inkjet print device according to the fifth aspect, the first calculation device measures a position of the line as the first depositing position for each of the divided line groups.

A seventh aspect may be configured such that the inkjet print device according to the sixth aspect further includes an approximate curve calculation device which calculates an approximate curve from the data of the first depositing position measured for each of the divided line groups, and a first deposit displacement amount calculating device which calculates the first deposit displacement amount from the approximate curve and the data of the first depositing position.

A eighth aspect may be configured such that in the inkjet print device according to the seventh aspect, the angle deviation amount is an angle in a rotation direction about an axis as a rotation center which is in a third direction orthogonal to a second direction and orthogonal to the first direction, the second direction being a width direction of the recording medium perpendicular to the first direction, and the angle deviation amount calculating device uses a calculatory moved position in a case where the position of the line is moved in the rotation direction by an angle $\theta r$ to calculate a calculatory deposit displacement amount in the case of the rotation by the angle $\theta r$, and calculate an angle $\theta adj$ with a standard deviation of the calculatory deposit displacement amount being minimum.

A ninth aspect may be configured such that in the inkjet print device according to the eighth aspect, the angle deviation amount calculating device calculates the angle $\theta adj$ for each of the divided line groups to calculate an average value of the angles $\theta adj$ calculated for the respective line groups.

A tenth aspect may be configured such that the inkjet print device according to any one of the first aspect to the ninth aspect further includes a determining device which determines presence or absence of abnormality based on a calculation result by the fourth calculation device, in which at least an operation of correction process or head maintenance is performed in a case where ejection abnormality is determined by the determining device.

An inkjet head ejection performance evaluation method according to an eleventh aspect includes a test pattern outputting step of, in an inkjet head having therein a plurality of nozzles arrayed in a matrix, recording a test pattern on a recording medium by the inkjet head, the test pattern being for examining an ejection condition for each of the nozzles, an image reading step of optically reading an image of the test pattern recorded on the recording medium, a first calculation step of measuring a first depositing position for each of the nozzles from the read image of the test pattern read in the image reading step, an angle deviation amount calculating step of calculating an angle deviation amount of the inkjet head with respect to a reference attaching angle based on the first depositing position measured in the first calculation step and pattern information of the test pattern, a second calculation step of calculating at least one of a second depositing position for each of the nozzles and a second deposit displacement amount for each of the nozzles in which an influence due to angle deviation caused by the angle deviation amount is eliminated from at least one of the first depositing position for each of the nozzles measured in the first calculation step and a first deposit displacement amount for each of the nozzles calculated based on data of the first depositing position, a third calculation step of calculating a moving amount caused by rotation of the angle deviation amount from a reference position of the nozzle at the reference attaching angle up to a current nozzle position based on the angle deviation amount calculated in the angle deviation amount calculating step, and a fourth calculation step of using calculation results in the second calculation step and the third calculation step to calculate at least one of a distance between adjacent pixels including the influence due to the angle deviation and a third deposit displacement amount for each of the nozzles including the influence due to the angle deviation.

In the eleventh aspect, matters the same as the matters specified from the first aspect to the tenth aspect may be adequately combined. In this case, a device which performs the processes and functions specified in the inkjet print device may be grasped as an element of "steps" of corresponding processes and functions.

According to the present invention, the ejection condition of each nozzle can be accurately evaluated even in a case where the inkjet head is attached with having the angle deviation in the rotation direction along the recording surface of the recording medium.

BRIEF DESCRIPTION OF THE DRAWINGS

FIG. 15 is a graph showing a relationship between an angle $\theta_r$ and a calculated deposit displacement standard deviation a;

DETAILED DESCRIPTION OF THE EMBODIMENTS

Hereinafter, a description is given of the preferred embodiments of the present invention in detail with reference to the attached drawings.

<<Configuration Example of Inkjet Print Device>>

Figure 1:
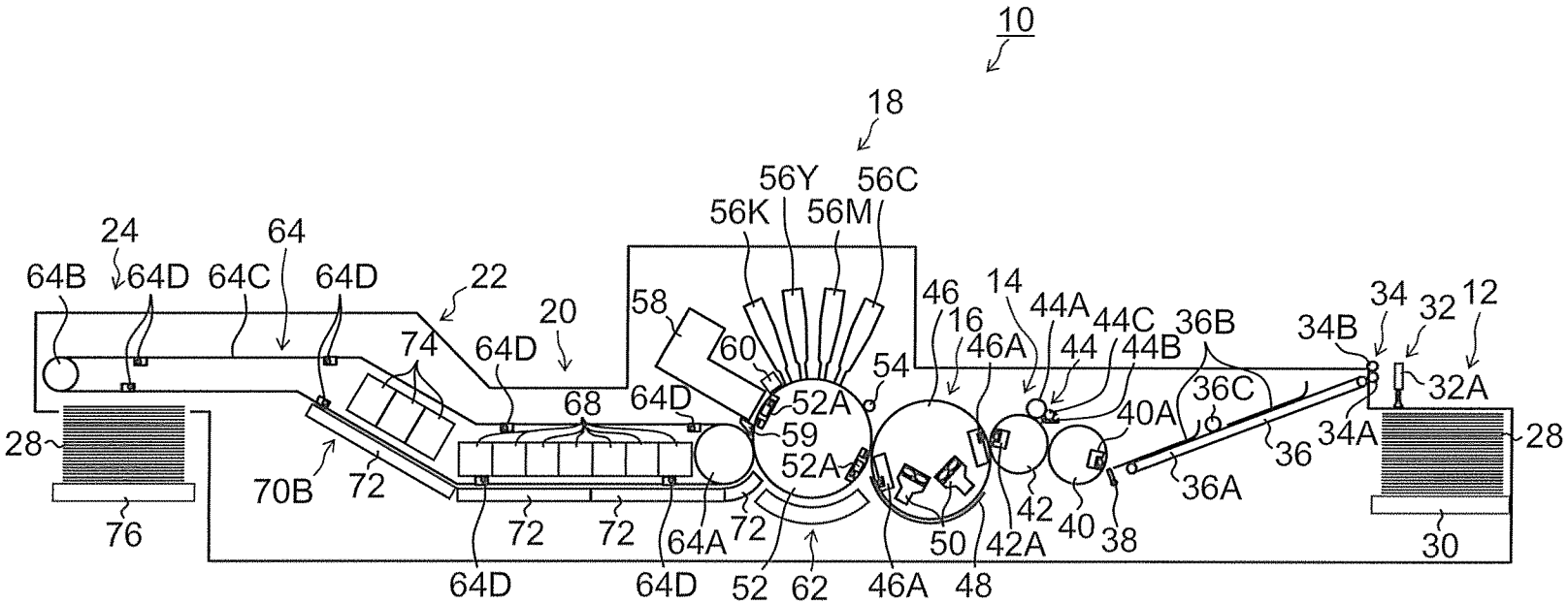
FIG. 1 is a configuration view of an inkjet print device according to an embodiment.

FIG. 1 is a configuration view of an inkjet print device according to an embodiment. An inkjet print device 10 includes a paper feed unit 12, a treatment liquid applying section 14, a treatment liquid drying treatment unit 16, an image formation unit 18, an ink drying treatment unit 20, a UV (ultraviolet) irradiation treatment unit 22, and a paper output unit 24.

The paper feed unit 12 is a mechanism for feeding a recording medium 28 to the treatment liquid applying section 14. The paper feed unit 12 includes a paper feed platform 30, a paper feed device 32, a paper feed roller pair 34, a feeder board 36, a front stop 38, and a paper feed drum 40, and feeds a recording medium 28 as a paper sheet stacked on the paper feed platform 30 one by one to the treatment liquid applying section 14. Note that in the example, a cut paper sheet (cut sheet) is used as the recording medium 28, but there may be also used a configuration in which a sheet of a required size is cut out from continuous paper (roll paper) to feed.

The recording media 28 stacked on the paper feed platform 30 are lifted from the top thereof one by one by a suction fit 32A of the paper feed device 32 and fed to the paper feed roller pair 34. The recording medium 28 fed to the paper feed roller pair 34 is fed forward by a vertical pair of rollers 34A and 34B to be placed on the feeder board 36. The recording medium 28 placed on the feeder board 36 is conveyed by a tape feeder 36A provided on a conveying surface of feeder board 36.

The recording medium 28 is pressed against the conveying surface of the feeder board 36 by a retainer 36B and a guide roller 36C in a conveying course by way of the feeder board 36 to correct irregularity. The recording medium 28 conveyed by the feeder board 36 abuts on the front stop 38 at the leading end thereof to be corrected in inclination. After that, the recording medium 28 is conveyed to the treatment liquid applying section 14 with a leading end portion thereof being gripped by a gripper 40A of the paper feed drum 40.

The treatment liquid applying section 14 is a mechanism for applying a treatment liquid on the recording surface of the recording medium 28. The treatment liquid applying section 14 includes a treatment liquid applying drum 42 and a treatment liquid applying unit 44.

The treatment liquid contains a constituent which aggregates or thickens coloring materials (pigment or dye) in the ink. Examples of a method for aggregating or thickening the coloring materials include those using a treatment liquid which reacts with the ink to precipitate or insolubilize the coloring material in the ink and a treatment liquid generating a semisolid substance (gel) including the coloring material in the ink, for example. Examples of a measure for causing the reaction between the ink and the treatment liquid include a method for reacting an anionic coloring material in the ink with a cationic compound in the treatment liquid, a method in which the ink and the treatment liquid different from each other in pH (potential of hydrogen) are mixed to change the pH of the ink so as to cause dispersion destruction of the pigment in the ink to aggregate the pigment, and a method in which reaction with a multivalent metal salt in the treatment liquid causes dispersion destruction of the pigment in the ink to aggregate the pigment.

The recording medium 28 fed from the paper feed unit 12 is transferred from the paper feed drum 40 to the treatment liquid applying drum 42. The treatment liquid applying drum 42 rotates with gripping a leading end of the recording medium 28 by a gripper 42A so as to convey the recording medium 28 in a state of being wrapped on a drum circumferential surface thereof.

In a conveying course for the recording medium 28 by way of the treatment liquid applying drum 42, a coating roller 44A given a constant amount of the treatment liquid measured by a measuring roller 44C from a treatment liquid pan 44B is pressed and brought to and into contact with a surface of the recording medium 28 to coat the treatment liquid on the surface of the recording medium. Note that an aspect for coating the treatment liquid is not limited to coating by a roller, and other aspects may be applied used such as inkjet printing and coating by means of a blade.

The treatment liquid drying treatment unit 16 includes a treatment liquid drying drum 46, a conveyance guide 48, and a treatment liquid drying treatment unit 50, and subjects the recording medium 28 given the treatment liquid to drying treatment.

The recording medium 28 transferred from the treatment liquid applying drum 42 to the treatment liquid drying drum 46 is gripped at the leading end thereof by a gripper 46A which is provided to the treatment liquid drying drum 46. The recording medium 28 is gripped by the gripper 46A in a state where a surface thereof on a side on which the treatment liquid is coated faces toward an inside of the treatment liquid drying drum 46. Additionally, a rear surface of the recording medium 28 (which is opposite to the side on which the treatment liquid is coated) is supported by the conveyance guide 48. In this state, the treatment liquid drying drum 46 is rotated to convey the recording medium 28.

The treatment liquid drying treatment unit 50 is provided to the inside of the treatment liquid drying drum 46. In a course of conveying the recording medium 28 by the treatment liquid drying drum 46, the surface of the recording medium 28 receives a hot air blown by the treatment liquid drying treatment unit 50 such that the recording medium 28 is subjected to the drying treatment. This removes a solvent component in the treatment liquid to form an ink aggregation layer on the surface of the recording medium 28.

The image formation unit 18 includes an image forming drum 52, a paper sheet pressing roller 54, head units 56C, 56M, 56Y, and 56K, an inline sensor 58, a mist filter 60, and a drum cooling unit 62.

The image forming drum 52 which is provided with a gripper 52A can hold the leading end of the recording medium 28 by the gripper 52A. The recording medium 28 is conveyed in a state where the leading end thereof is held by the gripper 52A by way of rotation of the image forming drum 52. The image forming drum 52 has a plurality of suction apertures (not shown) on a circumferential surface thereof so as to hold the recording medium 28 by suction on the circumferential surface of the image forming drum 52 with a negative pressure generated through the suction apertures.

The paper sheet pressing roller 54 presses the recording medium 28 conveyed by the image forming drum 52 to make the recording medium 28 tightly contact with a circumferential surface of the image forming drum 52. In other words, the recording medium 28 transferred from the treatment liquid drying drum 46 to the image forming drum 52 is gripped at the leading end thereof by the gripper 52A of the image forming drum 52. Further, the recording medium 28 is made to pass under the paper sheet pressing roller 54 such that the recording medium 28 is brought into tight contact with the circumferential surface of the image forming drum 52.

The recording medium 28 brought into tight contact with the circumferential surface of the image forming drum 52 is suctioned with the negative pressure generated through the suction apertures formed on the circumferential surface of the image forming drum 52 so as to be held by suction on the circumferential surface of the image forming drum 52.

The recording medium 28 fixed on the image forming drum 52 is conveyed in a state where the recording surface faces an outer side, and given the ink applied on the recording surface of the recording medium 28 from the head units 56C, 56M, 56Y, and 56K in passing through an ink droplets deposition area immediately beneath the head units 56C, 56M, 56Y, and 56K. The mist filter 60 is a filter for catching ink mist.

The head unit 56C is a liquid droplets ejection unit for ejecting liquid droplets of ink of cyan (C). The head unit 56M is a liquid droplets ejection unit for ejecting liquid droplets of ink of magenta (M). The head unit 56Y is a liquid droplets ejection unit for ejecting liquid droplets of ink of yellow (Y). The head unit 56K is a liquid droplets ejection unit for ejecting liquid droplets of ink of black (K). The head units 56C, 56M, 56Y, and 56K are respectively supplied with the inks of corresponding colors from ink tanks not shown.

The head unit 56C, 56M, 56Y, and 56K each are a full-line type inkjet recording head having a length corresponding to a maximum width of an image forming area in the recording medium 28, and an ink ejecting surface of the head has a plurality of ink ejecting nozzles two-dimensionally arrayed in a matrix thereon over the entire width of the image forming area. The full-line type recording head is also referred to as a "page-wide head". Each of the head units 56C, 56M, 56Y, and 56K corresponds to an aspect of the "inkjet head".

The head units 56C, 56M, 56Y, and 56K are disposed so as to extend in a direction perpendicular to a conveying direction (rotation direction of a drawing drum 70) of the recording medium 28. The conveying direction recording medium 28 is referred to as a "sub-scanning direction", and the width direction of the recording medium 28 which is perpendicular to the sub-scanning direction is referred to as a "main scanning direction". A description is given herein assuming that the sub-scanning direction is a Y direction and the main scanning direction is an X direction.

In a case of the inkjet head having a two-dimensional nozzle array, it may be considered that a projected nozzle alignment in which the nozzles in the two-dimensional nozzle array are projected (orthogonal projection) so as to be aligned along the main scanning direction is equivalent to one row of a nozzle alignment in which the nozzles are aligned approximately at regular intervals in the main scanning direction at a nozzle density attaining a maximum print resolution. The term "approximately at regular intervals" means that droplet deposition points recordable by the inkjet print device are substantially at regular intervals. For example, the concept of "regular intervals" includes a case where the interval is slightly differentiated in consideration of a manufacturing error or movement of liquid droplets on the recording medium 28 due to deposit interference. When the projected nozzle alignment (also referred to as a "substantial nozzle alignment") is considered, each of orders in which the projection nozzles are aligned in the main scanning direction can be associated with the nozzle number representing the nozzle position.

An operation only one time to move the recording medium 28 relative to the full-line type head units 56C, 56M, 56Y, and 56K like this, that is, one time sub-scanning, allows an image of a prescribed print resolution to be recorded on the image forming area of the recording medium 28. A drawing method capable of completing an image with one drawing scanning is called single-pass printing. The image forming drum 52 corresponds to an aspect of a "relative moving device".

A droplet ejection timing for each of the head units 56C, 56M, 56Y, and 56K is synchronized with a signal of an encoder (encoder signal) not shown which detects a rotation speed of the image forming drum 52. An ejection triggering signal is generated based on the encoder signal to control the droplet ejection timings for the head units 56C, 56M, 56Y, and 56K based on the ejection triggering signal. Additionally, speed variation due to a wobble of the image forming drum 52 or the like is learned in advance to correct the droplet ejection timing obtained by the encoder such that droplet deposition non-uniformity can be reduced independently of the wobble of the image forming drum 52, accuracy of a rotary shaft, and a speed of the outer circumferential surface of the image forming drum 52.

Although a configuration with the CMYK standard colors (four colors) is described in the example, combinations of the ink colors or the number of colors are not limited to those, and light inks, dark inks or special color inks may be added as required. For example, there may be also used a configuration in which the head unit ejecting a light series ink such as light cyan and light magenta is added, and an order to arrange the heads of the respective colors is not specifically limited.

Further, a head maintenance operation such as cleaning of nozzle surfaces of the head units 56C, 56M, 56Y, and 56K, and thickened ink discharge is performed after retracting the head units 56C, 56M, 56Y, and 56K from the image forming drum.

The inline sensor 58 is an optical reading device which optically reads the image recorded on the recording medium 28 to generate data of the read image. The inline sensor 58 corresponds to an aspect of an "image reading device". The read image is also called a "scanned image". The inline sensor 58 includes a color CCD linear image sensor which performs color separation into three colors of R (red), G (green), and B (blue), for example. The term CCD is an abbreviation for Charge-Coupled Device. Note that a color CMOS linear image sensor may be used in place of the color CCD linear image sensor. The term CMOS is an abbreviation for Complementary Metal Oxide Semiconductor.

When the recording medium 28 in which the image is formed by the head units 56C, 56M, 56Y, and 56K passes through a reading area of the inline sensor 58, the image formed on the surface is read. Examples of the image printed on the recording medium 28, besides an image to be printed which is specified by the printing job, can include a nozzle state check pattern for examining the ejection condition for each nozzle, a printing density correction test pattern, a printing density unevenness correction test pattern, and other various test patterns.

The image reading by the inline sensor 58 is carried out as required to detect ejection defection or image defection (image abnormality) such as the printing density unevenness from the read image data. The recording medium 28 after passing through the reading area of the inline sensor 58 passes through beneath a guide 59 after the suction is released and is transferred to the ink drying treatment unit 20.

The ink drying treatment unit 20 includes an ink drying treatment unit 68 which subjects the recording medium 28 conveyed by a chain gripper 64 to drying treatment. The ink drying treatment unit 20 subjects the recording medium 28 after the image formation to the drying treatment to remove a liquid component remaining on the surface of the recording medium 28.

Configuration examples of the ink drying treatment unit 68 include an aspect which includes a heat source such as a halogen heater and an infrared heater, and a fan blowing an air heated by the heat source to the recording medium 28.

The recording medium 28 transferred from the image forming drum 52 in the image formation unit 18 to the chain gripper 64 is gripped at the leading end thereof by a gripper 64D which is provided to the chain gripper 64. The chain gripper 64 has a structure in which a pair of endless chains 64C is wound around a first sprocket 64A and a second sprocket 64B.

The rear surface of a rear end of the recording medium 28 is held by suction on by a paper sheet holding surface of a guide plate 72 which is arranged at a certain distance from the chain gripper 64.

The UV irradiation treatment unit 22 includes a UV irradiation unit 74, and uses an ultraviolet curable ink to irradiate the recorded image with ultraviolet rays to fix the image on the surface of the recording medium 28.

When the recording medium 28 conveyed by the chain gripper 64 reaches a UV ray irradiation region of the UV irradiation unit 74, it is subjected to UV irradiation treatment by the UV irradiation unit 74 provided inside the chain gripper 64.

In other words, the recording medium 28 conveyed by the chain gripper 64, in a conveying path for the recording medium 28, is irradiated with the ultraviolet rays from the UV irradiation unit 74 which is arranged at a position corresponding to the surface of the recording medium 28. A curing reaction occurs in the ink irradiated with the ultraviolet rays and the image is fixed on the surface of the recording medium 28.

The recording medium 28 subjected to the UV irradiation treatment is transferred via an inclined conveying path 70B to the paper output unit 24. A cooling treatment unit may be included which subjects the recording medium 28 passing through the inclined conveying path 70B to cooling treatment.

The paper output unit 24 includes a paper output platform 76 which collects in a stacking manner the recording medium 28 having been subjected to a series of image formation process. The chain gripper 64 releases the recording medium 28 above the paper output platform 76 to stack the recording medium 28 on the paper output platform 76. The paper output platform 76 collects the recording medium 28 released from the chain gripper 64 in a stacking manner. The paper output platform 76 is provided with sheet guides (not shown) (a front sheet guide, a rear sheet guide, a side sheet guide, and the like) such that the recording media 28 are orderly stacked.

The paper output platform 76 is provided by means of a paper output platform lifting and lowering device so as to be lifted and lowered. The paper output platform lifting and lowering device is controlled to be driven in conjunction with increase or decrease of the recording medium 28 stacked on the paper output platform 76 to lift and lower the paper output platform 76 such that the recording medium 28 placed on the top of the stack is always positioned at a certain height.

[Structural Example of Head Unit]

Figure 2:
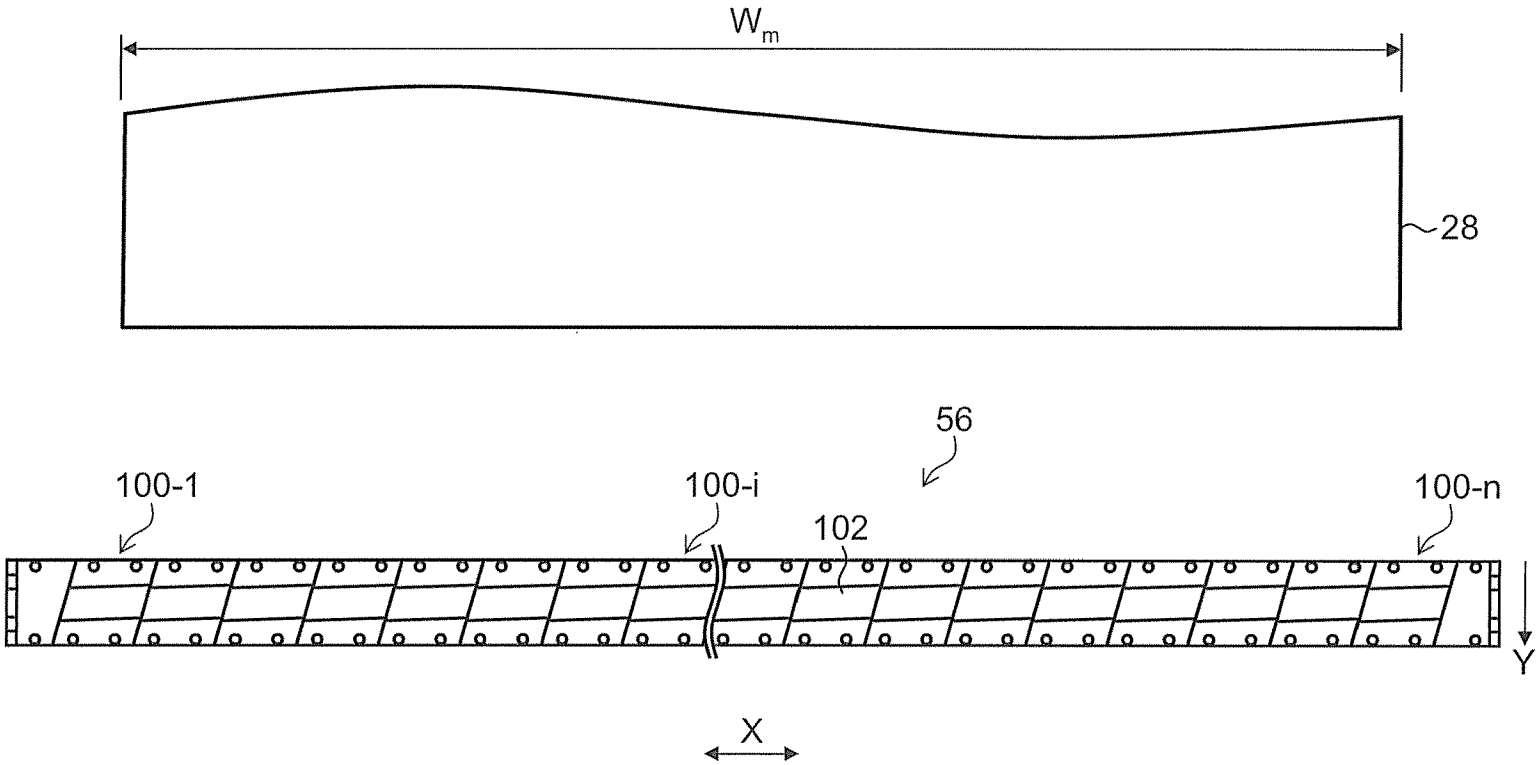
FIG. 2 is a configuration view of a head unit.

FIG. 2 is a configuration view of the head unit 56. Since the head units 56C, 56M, 56Y, and 56K illustrated in FIG. 1 have the same structure applied, these are expressed as the head unit 56 when they do not need to be distinguished.

The head unit 56 shown in FIG. 2 has a structure in which plural inkjet heads 100-*i* are coupled with each other in the width direction (X direction) of the recording medium 28 perpendicular to the conveying direction (Y direction) of the recording medium 28. A branch number "i" suffixed after "-" (hyphen) of reference numeral and character "100-*i*" is an integer from 1 to n and represents the i-th head module. The integer n here is the number of the inkjet heads constituting the head unit 56 as an inkjet head bar, and FIG. 2 shows an example of n=17. Since the inkjet heads 100-*i* (i=1, 2, . . . n) has also the same structure applied, these are expressed as an inkjet head 100 when they do not need to be distinguished.

Figure 3:
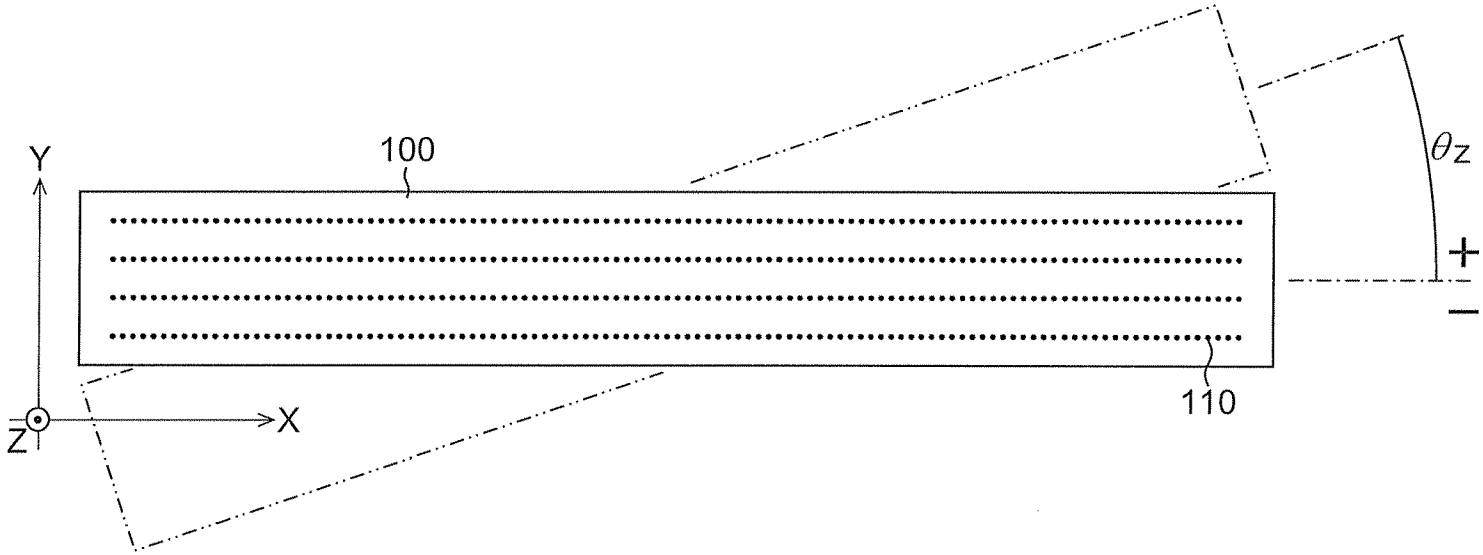
FIG. 3 is a schematic perspective plan view of an inkjet head seen down toward an ink ejected direction.

A nozzle surface 102 of the inkjet head 100 has a plurality of openings of the nozzles arranged thereon (not shown in FIG. 2, but shown in FIG. 3 and designated by reference numeral 110). The "nozzle surface" is equivalent to the "ink ejecting surface".

The head unit 56 is a multi-nozzle head in which plural nozzles are arranged in a matrix across a length corresponding to an entire width Wm of the recording medium 28. The "entire width of the recording medium 28" corresponds to an entire length of the recording medium 28 in the width direction of the recording medium 28. The multi-nozzle head in which plural nozzles are arrayed in a matrix is called a "matrix head".

FIG. 3 is a schematic perspective plan view of the inkjet head 100 seen down toward an ink ejected direction; FIG. 3 schematically shows the nozzle array in a matrix which is shown as an array simpler than an actual array form. As shown in FIG. 3, a description is given with introducing an XYZ triaxial rectangular coordinate system. The recording medium conveying direction is assumed to be the Y direction. The recording medium width direction orthogonal to the Y direction is assumed to be the X direction. A direction orthogonal to an XY plane is defined as the Z direction. The Y direction corresponds to a "first direction", the X direction corresponds to a "second direction", and the Z direction corresponds to a "third direction".

The Z direction is a direction orthogonal to the recording surface of the recording medium 28 which faces the inkjet head 100 (not shown in FIG. 3, see FIG. 1 and FIG. 2), and corresponds to a normal line of the recording medium 28. A rotation angle about a Z-axis of the inkjet head 100 is referred to as a "head rotation angle" and represented by "θz". That is, the head rotation angle θz represents the rotation angle along the XY plane in the rotation direction of the inkjet head 100.

A relative positional relationship between the recording medium 28 (not shown in FIG. 3, see FIG. 1 and FIG. 2) and the inkjet head 100 is that the recording medium 28 is positioned at a lower side in a direction of gravitational force than the inkjet head 100 which is arranged upward with respect to the recording surface of the recording medium 28. In the case of FIG. 3, the recording medium 28 is arranged at a position in a more minus direction of the Z-axis than the inkjet head 100 and the ink is ejected from nozzles 110 of the inkjet head 100 toward the minus direction of the Z-axis.

An example of the number of the nozzles 110 of the inkjet head 100 shown in FIG. 3 is 2048. The inkjet head 100 is the matrix head in which 2048 nozzles 110 are two-dimensionally arrayed in a matrix of 4 rows×512 columns. In the two-dimensional nozzle array of the matrix head, the X direction corresponds to a "row direction" and the Y direction corresponds to a "column direction".

Although simplified in FIG. 3, in the inkjet head 100, there are four nozzle rows at different locations in the Y direction, each nozzle row having the nozzles 110 aligned in the X direction at 300 npi, and the nozzle positions are shifted in the X direction between the respective nozzle rows from each other by 21.2 micrometers (μm). This attains the nozzle density of 1200 npi in the X direction all over the inkjet head 100. The term "npi" means nozzle per inch and is a unit representing the number of nozzles per one inch. One inch corresponds to 25.4 millimeters (mm). Since one nozzle can record a dot for one pixel, npi can be replaced with dpi to be understood. The term "dpi" means dot per inch and is a unit representing the number of dots (points) per one inch. The matrix head having the nozzle density in the X direction of 1200 npi is used for printing to attain a recording resolution of 1200 dpi in the X direction. The recording resolution is equivalent to the print resolution.

If the inkjet head 100 has the nozzle array in a matrix as shown in FIG. 3, a projected nozzle pitch of nozzles which are projected to an X-axis with respect to a rotation on the XY plane is changed from a proper nozzle pitch. The "proper nozzle pitch" means a design ideal nozzle pitch. The nozzle pitch is equivalent to the nozzle interval. In the example, a design nozzle density is 1200 npi, and thus, the proper nozzle pitch is 21.2 micrometers (μm).

Here, a proper head rotation angle θz with which the nozzles 110 projected to the X-axis are aligned at 1200 npi is defined as θz=0. A sign for θz is defined such that a counterclockwise rotation is positive as in FIG. 3. θz=0 corresponds to a reference attaching angle of the inkjet head 100.

Figure 4:
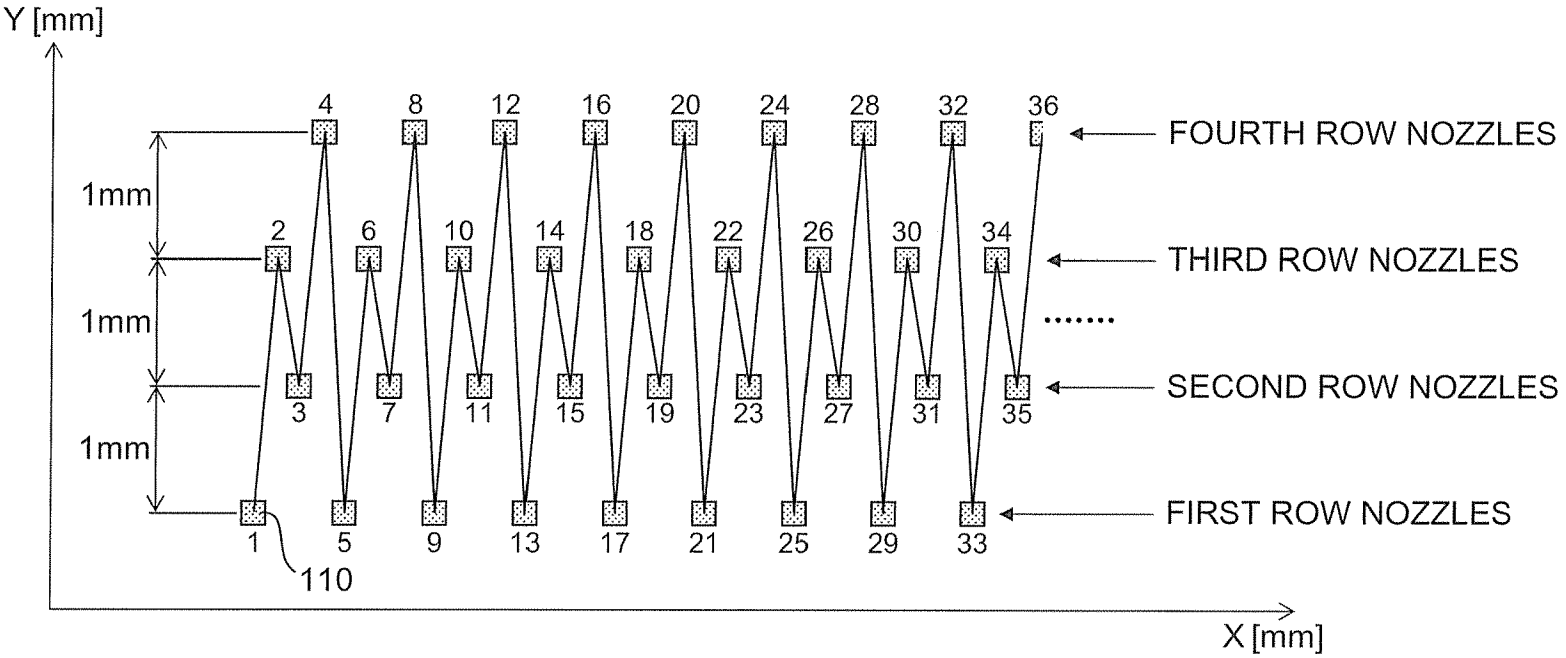
FIG. 4 is an enlarged view of a nozzle array in a matrix shown in FIG. 3.

FIG. 4 is an enlarged view of the nozzle array in a matrix shown in FIG. 3. Each of black solid tetragons in FIG. 4 represents the nozzle position and a numeral designating the nozzles 110 is the nozzle number. The nozzle number is given in accordance with an order in an alignment on the X-axis obtained by projecting X coordinates of the nozzles 110 to the X-axis. In FIG. 4, for the purpose of ease of description, a leftmost nozzle 110 in FIG. 4 is given the nozzle number of No. 1. Note that an origin of the XY coordinates of the X-axis and Y-axis may be arbitrarily set, but the position of the center of gravity in the nozzle array in a matrix is set for the origin in the example for the purpose of ease of calculation.

In the nozzle array in a matrix shown in FIG. 4, the lowermost nozzle row is defined as a "first row", and row numbers are defined in an order of a second row, a third row, and a fourth row upward in FIG. 4 from the first row. The nozzles belonging to the first row are referred to as "first row nozzles". Similarly, the nozzles belonging to the second row are referred to as "second row nozzles", the nozzles belonging to the third row are referred to as "third row nozzles", and the nozzles belonging to the fourth row are referred to as "fourth row nozzles".

Each nozzle row has the nozzles 110 aligned therein at the nozzle density at 300 npi. If the X coordinates of the nozzles 110 are projected to the X-axis, the nozzles 110 are positioned on the X-axis at the nozzle density of 1200 npi. A distance between the nozzle rows in the Y direction is assumed to be 1 millimeter (mm) for the sake of calculation.

[Explanation of Measurement Method of Deposit Displacement Amount for Each Nozzle]

Next, a description is given of a method for measuring the deposit displacement amount for each nozzle from the printed result of the nozzle state check pattern. The nozzle state check pattern is a test pattern for detecting an ejection defective nozzle and is equivalent to a "defective nozzle detection test pattern".

Figure 5:
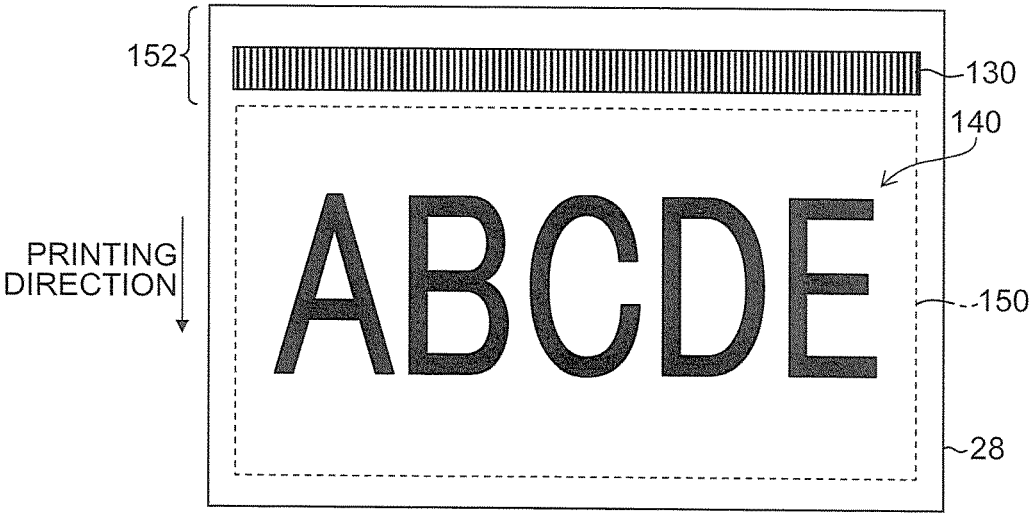
FIG. 5 is an illustration showing an example of a printed matter on which a nozzle state check pattern is recorded for examining an ejection condition for each nozzle.

FIG. 5 is an illustration showing an example of a printed matter on which the nozzle state check pattern is recorded for examining an ejection condition for each nozzle. In order to determine whether or not the nozzles 110 of the head unit 56 can be used for printing, the nozzle state check pattern 130 is printed on the recording medium 28, the printed result of the nozzle state check pattern 130 is read by the inline sensor 58 (see FIG. 1), and the ejection conditions of the nozzles 110 are examined from the obtained read image. The "ejection condition" includes at least the ejection direction of the nozzle (that is, a liquid droplet flying direction). The ejection direction of the nozzle is referred to as "ejection bending" in some cases. The ejection direction of the nozzle can be grasped from the depositing position where the liquid droplet ejected from the nozzle is deposited on the recording medium, that is, the dot forming position. Therefore, the examination of the ejection direction can be replaced with the examination of the depositing position to be understood. The "ejection condition" can also include at least one of whether or not to eject and an ejected liquid droplets amount.

The recording surface of the recording medium 28 has an image printed area 150 where an image to be printed 140 is recorded, and a space area 152 which is an area outside the image printed area 150. The nozzle state check pattern 130 shown in FIG. 5 is printed on the space area 152 on the leading end side in the recording medium conveying direction of the recording surface of the recording medium 28. Conveying the recording medium 28 to the inkjet head 100 causes relative movement between the inkjet head 100 and the recording medium 28. In a case of the inkjet print device 10 using a full-line type line head, the conveying direction of the recording medium 28 corresponds to a direction of the relative movement between the inkjet head 100 and the recording medium 28.

The relative movement between the inkjet head 100 and the recording medium 28 and the ink ejection from the inkjet head 100 allow printing on the recording surface of the recording medium 28. A printing direction indicated by a downward arrow in FIG. 5 is a direction in which the print progresses with the relative movement between the recording medium 28 and the inkjet head 100, and is opposite to the recording medium conveying direction. In the example in FIG. 5, in order to evaluate the ejection performance of the inkjet head 100 in operation of the inkjet print device 10, a configuration is used in which the nozzle state check pattern 130 is printed on the space area 152 on the leading end side of the recording medium 28 and the image to be printed 140 is printed on the image printed area 150 of the recording medium 28, but the image to be printed 140 may not be printed on the recording surface of the recording medium 28 but only the nozzle state check pattern 130 may be printed.

Based on the read image data obtained by reading the printed result of the nozzle state check pattern 130 by the inline sensor 58, the deposit displacement for each nozzle 110 in the X direction (that is, ejection straightness) can be measured, and a distance in the X direction between the dot forming positions adjacent to each other in the X direction can be calculated. The dot forming position by means of each nozzle of the inkjet head is a position of the dot which the inkjet head can record on the recording medium, that is, a "position of a pixel" on the recording medium. The distance in the X direction between the dot forming positions adjacent to each other means a distance to the next pixel in the X direction. The distance in the X direction between the dot forming positions adjacent to each other is referred to as a "distance between the adjacent pixels". In a case where a position of each nozzle of the inkjet head is transformed into a position on the X-axis that is one of the coordinate systems, the nozzles adjacent to each other in an array of nozzles which are aligned in a line on the X coordinate system after transformation is referred to as "adjacent nozzles".

Figure 6:
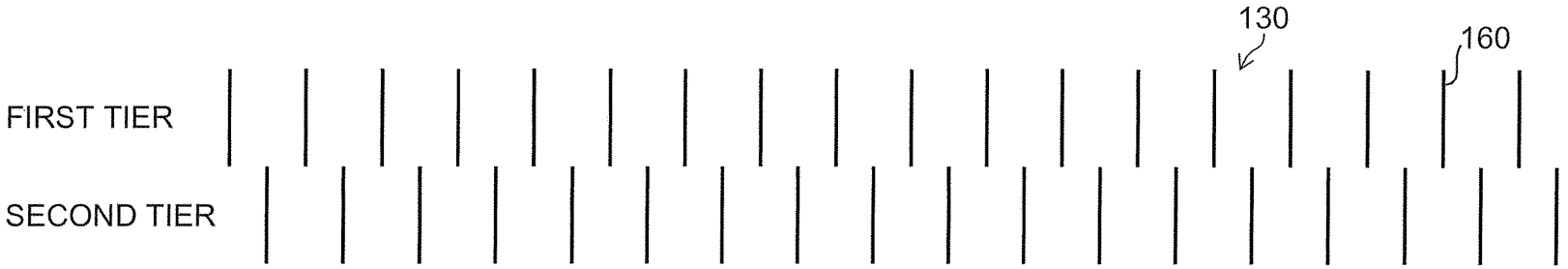
FIG. 6 is an illustration showing an example of a nozzle state check pattern.

FIG. 6 is an example of the nozzle state check pattern 130. FIG. 6 is a diagram where the nozzle state check pattern 130 with the number of divisions of two is created. In the embodiment, the number of divisions of k is referred to a case where a division patterns are formed at an interval of (k−1) nozzle lines in the X direction. Reference character k represents an integer equal to or more than 2. The nozzle state check pattern 130 shown in FIG. 6 is an example of a two-division pattern in which the all nozzles 110 contained in the inkjet head 100 are divided into two groups and the line pattern is recorded in a unit of the group. A block of the line pattern shown in the upper tier in FIG. 6 is called a first tier and a block of the line pattern shown in the lower tier is called a second tier. In the embodiment, since the inkjet head 100 of 1200 dpi is used (see FIG. 3 and FIG. 4), in the case of the two-division pattern shown in FIG. 6, lines 160 are aligned in one tier at 600 dpi. In the case of FIG. 6, the lines 160 each having the nozzle number of odd number are aligned in the first tier and the lines 160 each having the nozzle number of even number are aligned in the second tier.

As the liquid droplets of ink are ejected from the nozzles 110 of the inkjet head 100 and the recording medium 28 is conveyed, the liquid droplets of ink are deposited on the recording medium 28 and the lines 160 are printed each as a dot row in which the dots by the deposited ink are continuously aligned in the Y direction as in FIG. 6. In this way, the line 160 recorded by each nozzle 110 is a line segment having a predetermined length of one dot row in the Y direction which is recorded by way of continuous droplet ejection by one nozzle 110. The line segment of one dot row in the Y direction which is formed by one nozzle in the nozzle state check pattern 130 is called a "nozzle line" or simply a "line".

In a case of using the inkjet head 100 of high recording density, if the droplets are simultaneously ejected from the all nozzles 110, the dots from the adjacent nozzles partially overlap each other such that the line of one dot row is not formed. In order to prevent the lines 160 formed by the droplet ejection from the nozzles 110 from overlapping each other, it is desirable to arrange the simultaneously ejecting nozzles at an interval by at least one nozzle, preferably by three or more nozzles. The appropriate number of divisions may be set depending on the recording resolution of the inkjet head 100 of use.

The nozzle state check pattern 130 is illustrated in FIG. 6 with the number of divisions of two for the purpose of ease of description, but the printed lines overlap each other depending on the recording resolution of the inkjet head 100 if the number of divisions is too small, and therefore, the deposit displacement may not be measured in some cases. Moreover, if the number of divisions is too increased, a printed range for the nozzle state check pattern 130 elongates. For this reason, the number of divisions k is defined as an appropriate value from the point of view that the adjacent lines 160 are prevented from overlapping each other and the printed range for the nozzle state check pattern 130 on the recording medium 28 is made to fall within a proper size.

Figure 7:
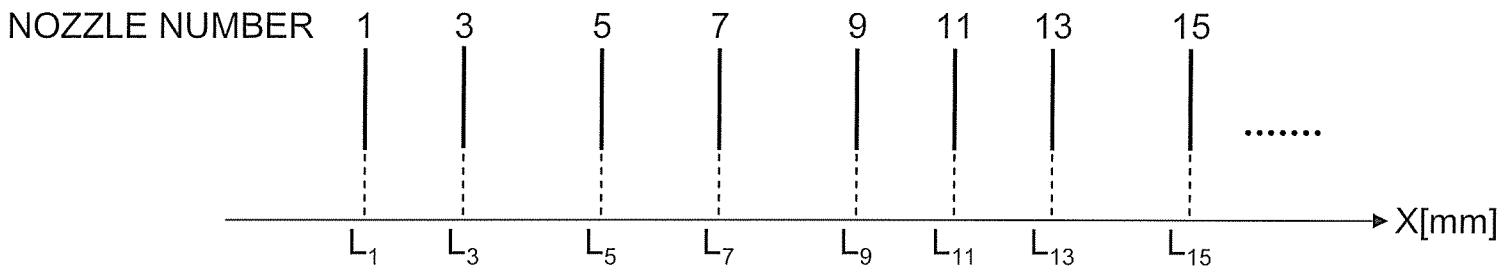
FIG. 7 is an explanatory illustration of a line group extracted from a first tier in the nozzle state check pattern shown in FIG. 6.

FIG. 7 shows a line group extracted from the first tier in the nozzle state check pattern 130 having the number of divisions of two shown in FIG. 6. The line group shown in FIG. 7 has lines therein aligned with a line gap equivalent to 600 dpi (about 42 micrometers (μm)) therebetween. A nozzle number i of the nozzle printing a line is defined such that a positional coordinate of the line in the X direction is $L_i$. Reference character representing the nozzle number is an integer equal to or more than 1. A positional coordinate of a line recorded by a nozzle of the nozzle number 1 is designated by $L_1$, a positional coordinate of a line recorded by the nozzle of a nozzle number 3 is designated by $L_3$, a positional coordinate of a line recorded by a nozzle of the nozzle number 5 is designated by $L_5$, a positional coordinates of a line recorded by a nozzle of the nozzle number 7 is designated by $L_7$, and so on. In FIG. 7, the positional coordinates of the lines of the nozzle numbers 1 to 15 are shown for the purpose of ease of illustration.

By scanning the printed nozzle state check pattern 130 by the inline sensor 58 and analyzing the obtained read image, print positions of the lines 160, that is, the positional coordinates of the lines 160 can be calculated. The positional coordinates of the lines 160 are referred to as "line coordinate". A suffix i of the line coordinate $L_i$ is called a line number. The line number is equal to the nozzle number of the nozzle 110 recording the line 160 at the line coordinate $L_i$.

Figure 8:
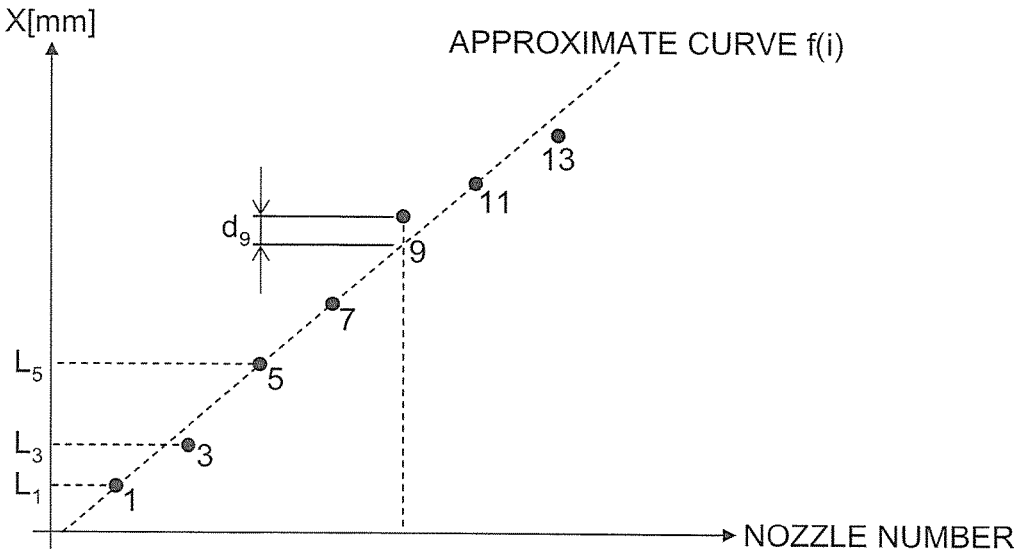
FIG. 8 is a graph showing an example of an approximate curve calculated based on measured data of line positions.

An approximate curve f(i) as shown in FIG. 8 can be drawn from the line coordinates of the lines shown in FIG. 7. As shown in FIG. 8, the nozzle number i is taken as an abscissa and the line coordinate $L_i$ is taken as an ordinate, and the approximate curve f(i) can be drawn from a set of measured data (i, $L_i$) which is measured from the read image of the printed result of the nozzle state check pattern 130.

In the embodiment, assuming that the approximate curve f(i) is obtained by creating a one-dimensional approximate curve by use of 20 lines respectively on both sides of a nozzle whose deposit displacement is wanted to be measured. Of course, the approximate curve may be two- or more-dimensional curve.

A deposit displacement amount $d_i$ for each line number i can be calculated by means of Formula (1) as below.

$$d_i = L_i - f(i) \qquad \text{Formula (1)}$$

In accordance with Formula (1), the deposit displacement amounts $d_1$, $d_3$, $d_5$, $d_7$ . . . of the nozzles can be calculated. FIG. 8 shows a deposit displacement amount $d_9$ for a line number 9.

As for the second tier also, the deposit displacement amounts $d_2$, $d_4$, $d_6$, $d_8$ . . . can be calculated similarly to the first tier.

In this way, the deposit displacement amounts for two tiers in the two-division pattern are respectively calculated and the obtained data is merged to allow the deposit displacement amounts of the all nozzles to be calculated. This can be also applied to the case of the number of divisions more than two to allow the deposit displacement of the all nozzles to be calculated in the same way. The point to note in this method is that the adjacent nozzle numbers belong to different tiers in the division pattern and calculation results of respective tiers are merged.

Note that in FIG. 8 the measurement method of the deposit displacement is described concerning the tier in the division pattern with a regular pitch, but the deposit displacements of the nozzles even for the division pattern with an irregular pitch can be measured by the same method. This is because, in a case of the division pattern with the irregular pitch, as compared with the case of the regular pitch illustrated in FIG. 8, the nozzle number taken as the abscissa is merely not the regular pitch (is the irregular pitch) and the approximate curve can be calculated.

[Distance Between Lines of Adjacent Nozzle Numbers]

Here, considered is an X direction distance between the lines of the adjacent nozzle numbers in the nozzle alignment arranged in the X direction at 1200 npi. Since the line coordinate $L_i$ of the nozzle number i represents the dot forming position of the nozzle of the nozzle number i in the X direction, the X direction distance between the lines of the adjacent nozzle numbers is an X direction distance between adjacent pixels corresponding to the adjacent nozzle numbers, that is, a distance between the adjacent pixels.

An ideal pixel pitch $P_{ideal}$ when the recording resolution is 1200 dpi is $P_{ideal}$=25.4 (mm)/1200 (dpi)=21.2 (μm). Assuming the X direction distance between the nozzle number i and the nozzle number i+1 is defined as $P_i$, Formula (2) below is obtained.

$$P_i = P_{ideal} + d_{i+1} - d_i \qquad \text{Formula (2)}$$

[Determination Method to be Normal or Abnormal]

If $P_i$ is smaller, an image is darkened to generate a black streak. On the other hand, if $P_i$ is larger, an image is lightened to generate a white streak. Therefore, an upper limit and a lower limited are set to a normal range of $P_i$, for example, such that abnormality of the streak generation can be detected. An example of the upper limit and the lower limit set to the normal range of $P_i$, the normal range of $P_i$ may be 10.2 μm<$P_i$<26.2 μm.

The smaller distance $P_i$ involving the black streak is not so distinct, but the larger distance $P_i$ involving the white streak is distinct, and therefore, the upper limit is more strictly defined than the lower limit concerning the setting of the normal range of $P_i$. The normal range dealing with $P_i$ as being normal may be changed as needed depending on an image level required for the inkjet print device. The "normal range" corresponds to an aspect of a "prescribed acceptable range".

When the distance $P_i$ between the pixels of the abnormal adjacent nozzles which is out of a predefined normal range is detected, of the nozzle of the nozzle number i and the nozzle of the nozzle number i+1 which define the distance $P_i$ between those pixels of the abnormal adjacent nozzles, the nozzle having larger one of absolute values of the deposit displacement amounts $|d_i|$ and $|d_{i+1}|$ is determined to be "abnormal". Then, the defective nozzle determined to be "abnormal" is not used for printing, and ejection amounts from the nozzles of the nozzle numbers which are on both side of the nozzle number of the defective nozzle are adequately increased to enable the streak to be indistinct. The correction process like this is referred to as a "non-ejection correction".

Further, the ejection amount where $P_i$ is smaller may be decreased and the ejection amount where $P_i$ is larger may be increased to reduce visibility of the streak. The correction process like this is referred to as a "printing density unevenness correction".

If the number of the adjacent nozzles where $P_i$ is determined to be abnormal is increased, head maintenance is performed such that the ejection performance can be recovered and a clean printed imaged can be obtained. The head maintenance is also referred to as head cleaning. The head maintenance may include at least one of sucking the nozzle, auxiliary ejection, and wiping the nozzle surface, for example.

[Explanation of Problem]

The above described measurement method of the deposit displacement amount $d_i$ has problems as below. That is, in the method of calculating and merging the deposit displacement amount for each tier in the division pattern, if θz is not zero, that is, if the inkjet head 100 has the angle deviation in the rotation direction about the Z-axis, a distance to the next line cannot accurately measured in some cases.

Figure 9:
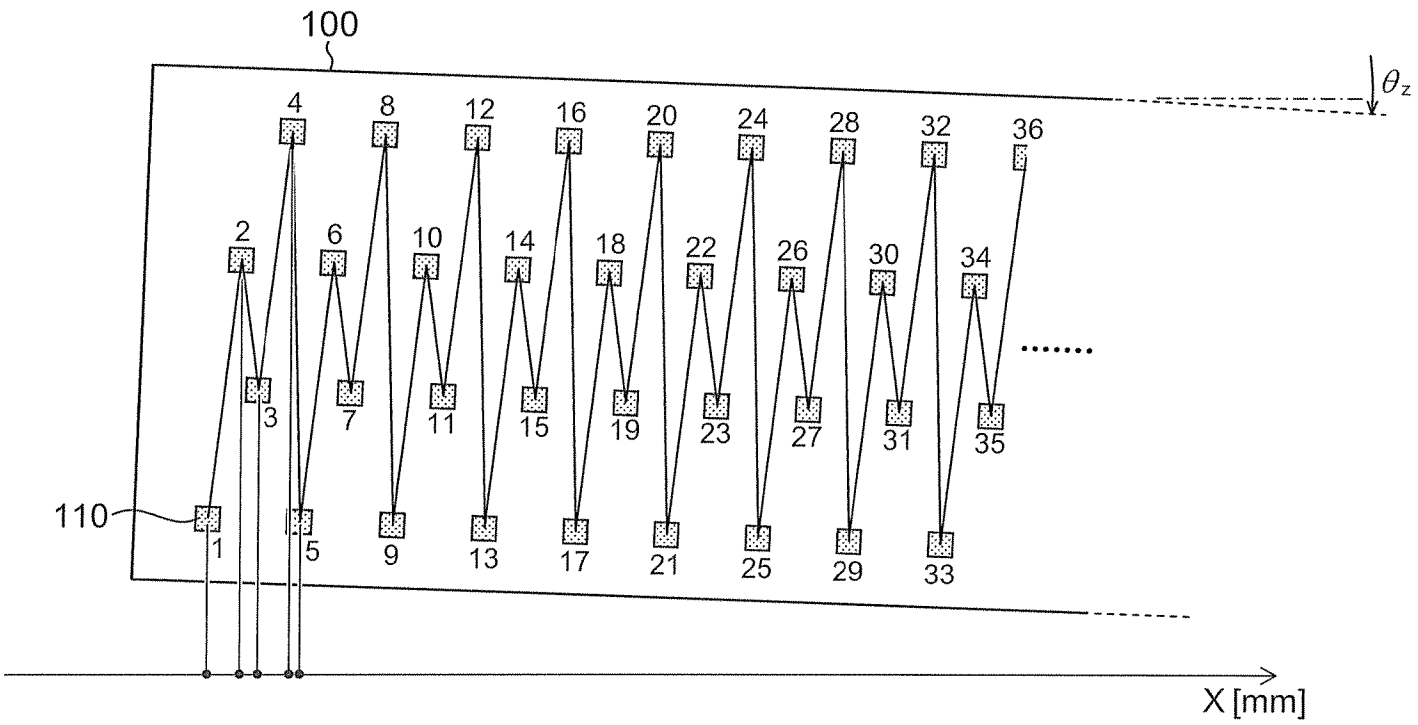
FIG. 9 is an explanatory illustration of nozzle positions in a case where the nozzle array shown in FIG. 4 is rotated.

In the matrix head of 1200 npi, the pitch of the nozzles which are otherwise (in the case of θz=0) aligned at the regular pitch of 21.2 micrometers (μm) may be smaller in some locations and larger in other locations than 21.2 micrometers in the case of θz≠0. FIG. 9 is an explanatory illustration of the nozzle positions in a case where the nozzle array shown in FIG. 4 is rotated by θz<0. As is clear from FIG. 9, an X direction interval between the nozzle number 1 and the nozzle number 2 is larger than the case in FIG. 4 (θz=0), and the X direction interval between the nozzle number 2 and the nozzle number 3 in FIG. 9 is smaller than the case in FIG. 4. Further, the X direction interval between the nozzle number 3 and the nozzle number 4 in FIG. 9 is larger, and the X direction interval between the nozzle number 4 and the nozzle number 5 is smaller.

Figure 10:
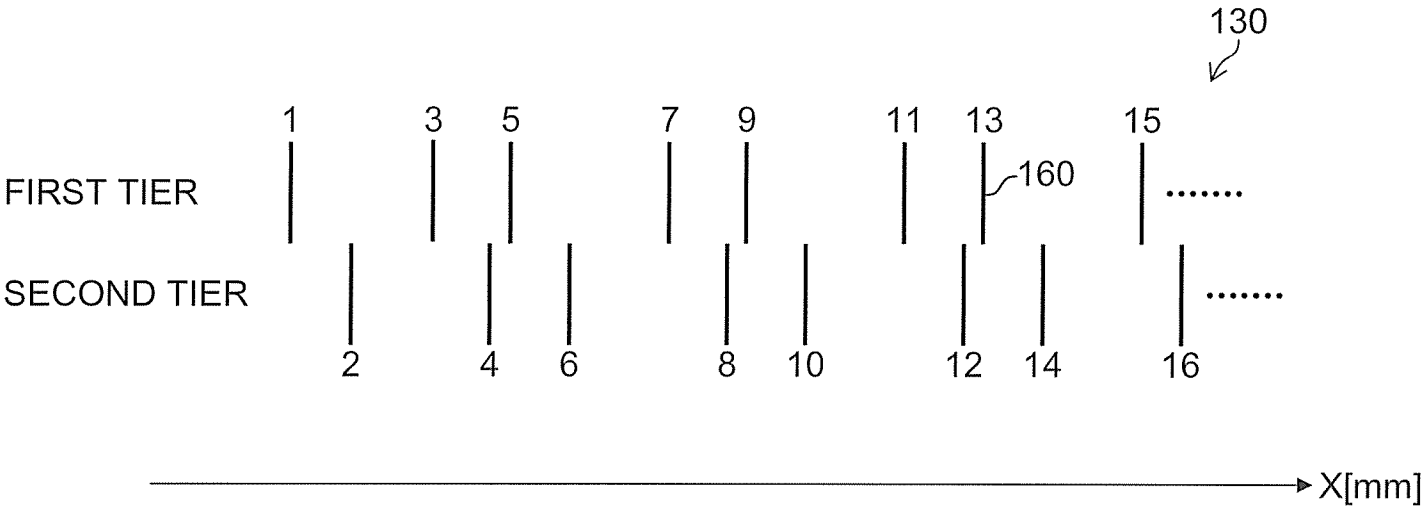
FIG. 10 is an illustration showing an example in case where the nozzle state check pattern is printed in a state where the inkjet head is rotated.

FIG. 10 is an example in which the nozzle state check pattern 130 with the number of divisions of two is printed in a state where the inkjet head 100 illustrated in FIG. 3 and FIG. 4 is rotated by θz<0. The numerals 1 to 16 designating the lines 160 are the nozzle numbers of the nozzles recording the respective lines 160.

The first tier in the nozzle state check pattern 130 shown in FIG. 10 is constituted by the lines 160 of the first row nozzles and second row nozzles. In other words, the first tier is recorded only by the first row nozzles and second row nozzles corresponding to lower half in FIG. 4 of the nozzle array having four rows in total. The second tier is constituted by the lines 160 of the third row nozzles and fourth row nozzles. In other words, the second tier is recorded only by the third row nozzles and fourth row nozzles corresponding to upper half in FIG. 4 of the nozzle array having four rows in total.

Assume that the rotation angle θz is −4 milliradians (mrad) as an example. FIG. 10 emphatically shows a line displacement for the purpose of easy understanding.

Figure 11:
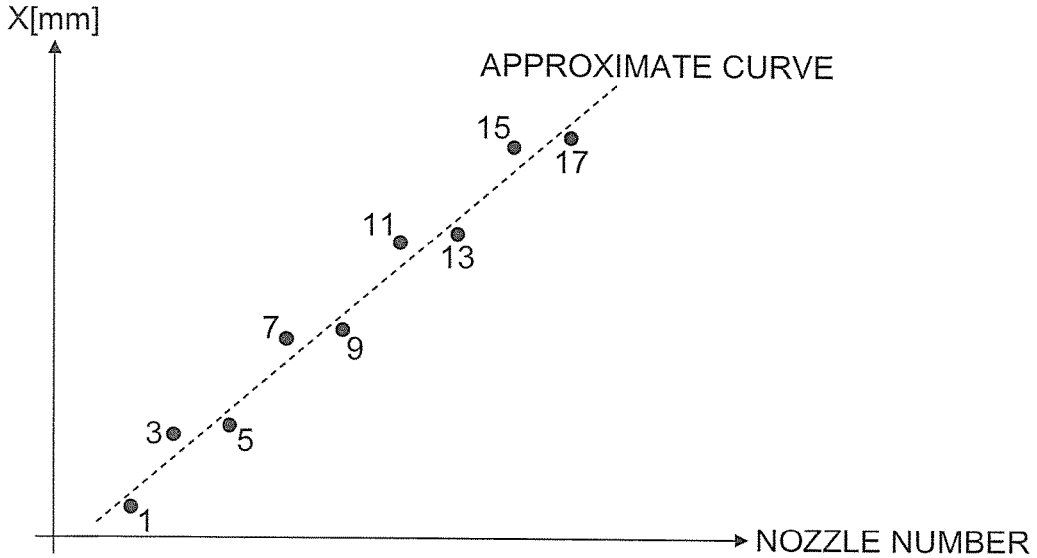
FIG. 11 is a graph showing a relationship between a nozzle number and a line coordinate of each line with which a first tier in the nozzle state check pattern shown in FIG. 10 is configured.

FIG. 11 is a graph showing a relationship between the nozzle number and the line coordinate of each line with which the first tier in the case of θz<0 shown in FIG. 10 is configured. As illustrated in FIG. 8, when the approximate curve is calculated based on a measurement result of the nozzle state check pattern in FIG. 10, an approximate curve as shown in FIG. 11 can be drawn. A difference between the approximate curve calculated in this way and an actual line coordinate is calculated as the deposit displacement amount. As a result, the deposit displacement amount has a value containing a component caused by the rotation by θz as shown in FIG. 12.

Figure 12:
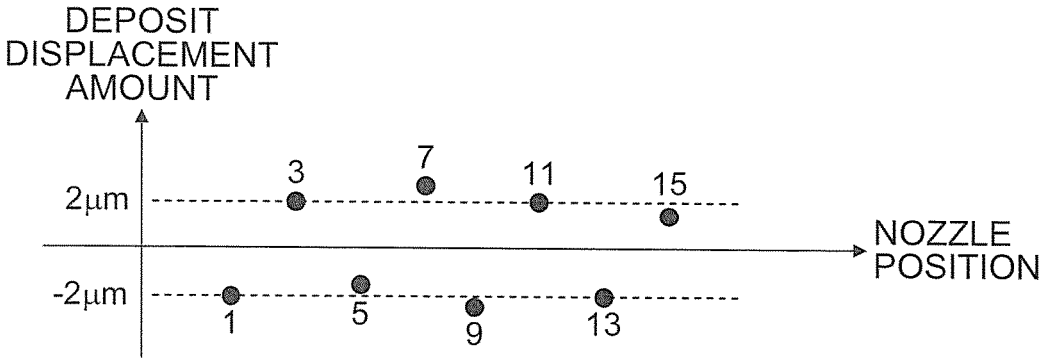
FIG. 12 is a graph collectively showing deposit displacement amounts of the nozzles calculated from a line pattern of the first tier in FIG. 10.

FIG. 12 is a graph collectively showing the deposit displacement amounts of the nozzles calculated from the line pattern of the first tier in FIG. 10. An abscissa in FIG. 12 represents the position of the nozzle and an ordinate represents the deposit displacement amount. In the example, since an absolute value of a rotation amount of the angle is 4 milliradians (mrad) and a Y direction distance between the nozzles of the first row nozzle and the second row nozzle is 1 millimeter (mm) (see FIG. 4), the deposit displacement amounts of the nozzles are generally ±2 micrometers (μm) deviation with an average being zero. The deposit displacement amount measured from the printed result of the nozzle state check pattern 130 is not only systematically affected due to the angle deviation of θz but also affected by random positional displacement which is intrinsic to the nozzle.

Figure 13:
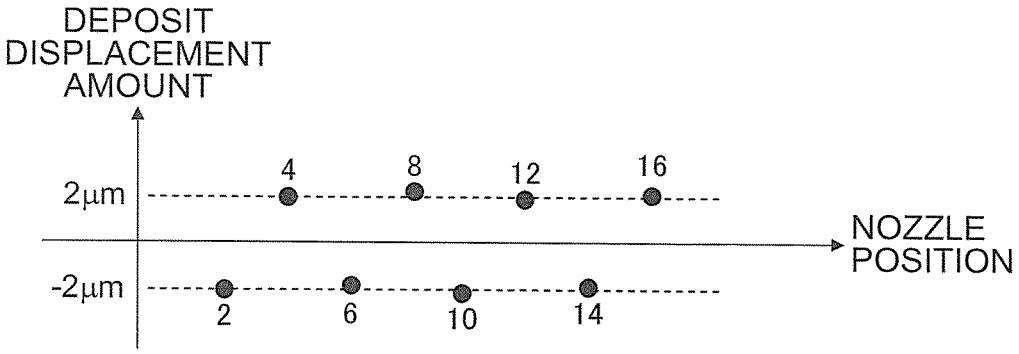
FIG. 13 is a graph collectively showing deposit displacement amounts of the nozzles calculated from a line pattern of a second tier in FIG. 10.

If the second tier is calculated similarly to the first tier, the same result is obtained as in FIG. 13. FIG. 13 is a graph collectively showing the deposit displacement amounts of the nozzles calculated from the line pattern of the second tier in FIG. 10.

The distance $P_i$ between the nozzles of the adjacent nozzle numbers in the X direction is calculated from the results in FIG. 12 and FIG. 13 to make the problem clear. For example, if the distance $P_6$ between the nozzle number 7 and the nozzle number 6 is P_ideal=21.2 micrometers (μm), and the influence due to the individual nozzles random positional displacements is eliminated, the result is as below.

$$P_6=21.2+d_7-d_6\approx 21.2+2-(-2)=25.2(\mu m) \quad \text{Formula (3)}$$

However, as is clear from FIG. 9, it can be seen that concerning a relative moving amount between the nozzle number 6 and the nozzle number 7 in X direction due to the θz rotation, these nozzles are naturally rather toward close to each other.

For example, the nozzle number 7 is rotated about the nozzle number 6 by θz=−4 milliradians (mrad), the nozzle number 7 moves in the X direction by about −4 micrometers (μm). In other words, $P_6$ is naturally to be 21.2 μm−4 μm=17.2 μm.

The result "$P_6$=25.2 μm" calculated in the method of related art as in Formula (3) is entirely different from "17.2 μm", and thus, if the result of the deposit displacement calculated in the method of related art is used for the abnormality determination or the correction process described above, the result thereof may possibly have a large error.

[Example of Solution for the Problem]

Figure 14:
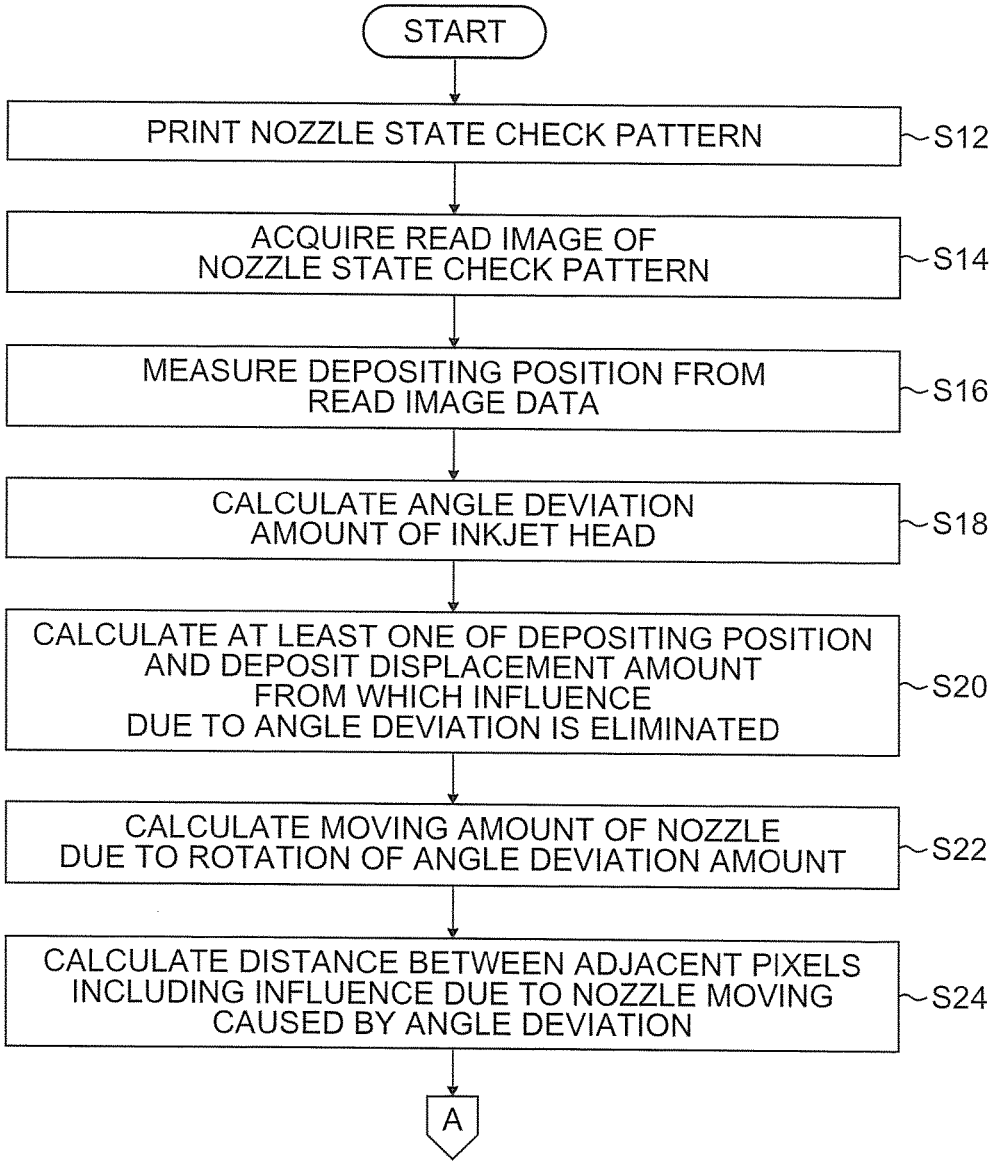
FIG. 14 is a flowchart showing a procedure of an inkjet head ejection performance evaluation method according to the embodiment.

FIG. 14 is a flowchart showing a procedure of an inkjet head ejection performance evaluation method according to the embodiment. The flowchart in FIG. 14 describes operations implemented by a control program or calculation processing function in a control apparatus of inkjet print device 10.

The inkjet head ejection performance evaluation method includes a step of printing the nozzle state check pattern 130 (step S12), a step of acquiring the read image of the nozzle state check pattern 130 (step S14), a step of measuring the depositing position from the read image data (step S16), a step of calculating an angle deviation amount of the inkjet head 100 based on the measurement result in step S16 (step S18), a step of calculating at least one of the depositing position and deposit displacement amount with the influence due to the angle deviation being eliminated, based on information about the angle deviation amount calculated in step S18 (step S20), a step of calculating the moving amount of the nozzle due to a rotation of the angle deviation amount (step S22), and a step of calculating a distance between the adjacent pixels including an influence due to nozzle moving caused by the angle deviation (step S24).

The nozzle state check pattern printing step at step S12 corresponds to an aspect of a "test pattern outputting step". The nozzle state check pattern 130 printed in step S12 is a division pattern having plural divided tiers as illustrated in FIG. 5 and FIG. 6.

In the read image acquiring step at step S14, the printed result of the nozzle state check pattern 130 is read by the inline sensor 58 to take in the read image data. Step S14 corresponds to an aspect of an "image reading step".

The depositing position measuring at step S16 corresponds to an aspect of a "first calculation step". At step S16, as illustrated in FIG. 7, the line position of each line is measured for each tier in the division pattern. The line position measured at step S16 corresponds to an aspect of a "first depositing position".

In the angle deviation amount calculating step at step S18, the data of the deposit displacement amount for each nozzle is used to calculate an angle θadj by means of which the influence due to the angle deviation can be eliminated from a current attaching condition of the inkjet head 100.

At step S20, the angle θadj calculated in step S18 is used to eliminate once the influence due to the angle deviation from the line coordinate $L_i$ or deposit displacement amount $d_i$ calculated by the procedure already described. The step in step S20 corresponds to an aspect of a "second calculation step".

At step S22, calculated is how distance the nozzle position of each nozzle is moved in viewed from a state of θz=0 in a case where the inkjet head 100 is put in a state of the current angle deviation. The step in step S22 corresponds to an aspect of a "third calculation step".

At step S24, the calculation result in step S20 is combined with the calculation result in step S22 to examine the distance between the adjacent pixels. The step in step S24 corresponds to an aspect of a "fourth calculation step".

Hereafter, a description is given of the detailed procedure of step S18 to step S24.

[Step S18]

As illustrated in FIG. 8, the deposit displacement data can be measured from the line group of a certain tier in the nozzle state check pattern 130. Concretely, considering the first tier in FIG. 10, the deposit displacement amounts of the respective nozzles can be found as $d_1$, $d_3$, $d_5$, and so on.

Here, these deposit displacement amounts $d_1$, $d_3$, $d_5$, and so on are used as a population to calculate a standard deviation σ micrometer (μm).

A calculation formula for the standard deviation σ may be described in Formula (4) as below.

Assuming an average value of the deposit displacement amounts $d_i$ is $m=\Sigma d_i$/the number of nozzles, $$\sigma=\{\Sigma(d_i-m)^2/(\text{the number of nozzles}-1)\}^{1/2} \quad \text{Formula (4)}$$

where Σ represents a sum concerning i for all.

Here, the coordinates $(x_i, y_i)$ is known which represents where the nozzle constituting the first tier in the nozzle state check pattern 130 is positioned on the nozzle surface (see FIG. 3 and FIG. 4).

The origin of the nozzle coordinates $(x_i, y_i)$ is defined so as to be positioned at the center of gravity of 2048 nozzles. In other words, assume there is a state satisfying:

$$\Sigma x_i=0 \quad \text{Formula (5)}$$

$$\Sigma y_i=0 \quad \text{Formula (6)}$$

where Σ represents a sum concerning i for all. In this way, by defining the origin of the nozzle coordinates, the average value of the moving amounts of the nozzle position with respect to an angle rotation in a θz direction in the XY plane can be made zero, simplifying the discussion.

Therefore, if the inkjet head is calculatedly rotated by a certain angle how distance the nozzle moves can be calculated. Assuming when the nozzle at the certain nozzle coordinates $(x_i, y_i)$ is rotated about the origin by the angle $\theta_r$, the nozzle is moved to a point $(x_{iA}, y_{iA})$, the X coordinate of the nozzle position after moving is represented by Formula (7).

$$x_{iA}=x_i\times\cos\theta_r-y_i\times\sin\theta_r \quad \text{Formula (7)}$$

Here, $\theta_r$ is a value as small as an order of $10^{-3}$ radian, and accordingly, Formula (8) and Formula (9) each hold as an approximation formula.

$$\cos\theta_r\approx 1-\theta_r^2/2 \quad \text{Formula (8)}$$

$$\sin\theta_r\approx\theta_r \quad \text{Formula (9)}$$

Accordingly, a moving amount Δx_i for each nozzle in the X direction can be calculated as below.

$$\begin{aligned}\Delta x_i &= x_{iA}-x_i \quad \text{Formula (10)}\\ &= x_i(\cos\theta_r-1)-y_i\times\sin\theta_r\\ &\approx x_i(1-\theta_r^2/2-1)-y_i\times\theta_r\\ &= -x_i\times\theta_r^2/2-y_i\times\theta_r\end{aligned}$$

In the embodiment, the first term on a right side of Formula (10) can be ignored. There are two reasons for that. A first reason is that, in the case of the embodiment, since the nozzles existing in a small area in the X direction are used to consider the relative positional displacement amount, an influence due to $x_i$ is cancelled. A second reason is that the first term on the right side of Formula (10) squaring $\theta_r$ is three orders of magnitude less than the second term in a state where $\theta_r$ is of the order of $10^{-3}$ radian.

Therefore, Formula (10) can be rewritten as Formula (11) ignoring the first term on the right side.

$$\Delta x_i=-y_i\times\theta_r \quad \text{Formula (11)}$$

The line position of the line printed on the recording medium can be calculated to be the X coordinate represented by Formula (12) below, by calculatedly rotating the inkjet head by $\theta_r$.

$$L_{iA} = L_i + \Delta x_i = L_i - y_i \times \theta_r \quad \text{Formula (12)}$$

If calculatory moving destinations $L_{1A}$, $L_{3A}$, $L_{5A}$ and so on of the lines of the first tier which are calculated as Formula (12) are used, similar to the example illustrated in FIG. 8, the calculatory deposit displacement amounts $d_{1A}$, $d_{3A}$, $d_{5A}$ and so on in the case of rotating by the angle $\theta_r$ can be calculated. In such a way, as the deposit displacement standard deviation σ is calculated while the angle $\theta_r$ is calculatedly changed, there is the angle θadj where the deposit displacement standard deviation σ is minimum as is in FIG. 15.

Figure 15:
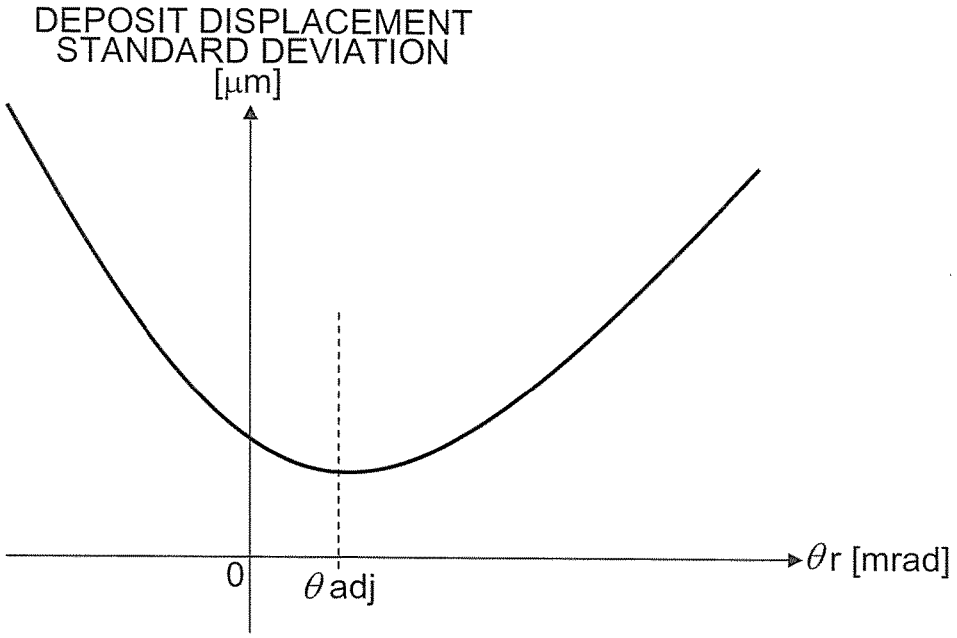

FIG. 15 is a graph showing a relationship between the angle $\theta_r$ and the deposit displacement standard deviation σ. An abscissa in FIG. 15 represents the angle $\theta_r$, which is represented by a milliradian (mrad). An ordinate represents the deposit displacement standard deviation σ, which is represented by a micrometer (μm).

The angle θadj with the deposit displacement standard deviation being minimum is the angle deviation amount which this inkjet head 100 currently has. In other words, there is currently inclination of an angle of (−1)×θadj.

The angle θadj is calculated hereinabove using the first tier of the nozzle state check pattern 130. Of course, the second tier of the nozzle state check pattern 130 may be used to calculate the angle θadj. In addition, a devisal may be made in which θadj_1 is calculated from the first tier and θadj_2 is calculated from the second tier, an average value of which is taken to lessen a measurement error. In other words, an average value θ_adj=(θadj_1+θadj—2)/2 may be used as an "angle with the deposit displacement standard deviation being minimum".

[Step S20]

The coordinate $L_{iA}$, of the line of each nozzle in the case where the inkjet head 100 can be adjusted to have the angle θadj can be calculated as below by use of Formula (12).

$$L_{iA}=L_i-y_i\times\theta\text{adj} \quad \text{Formula (13)}$$

From Formula (13), $L_{1A}$, $L_{3A}$, $L_{5A}$ and so on are defined for the first tier in the nozzle state check pattern 130, and the method described in FIG. 8 is used to calculate the deposit displacement amounts for the respective nozzles d_adj_1, d_adj_3, d_adj_5, and so on. As for the second tier in the nozzle state check pattern 130, the similar way is used to calculate the deposit displacement amounts for the respective nozzles d_adj_2, d_adj_4, d_adj_6, and so on.

If the results of the first tier and the second tier are merged, the deposit displacement amount d_adj_i with the influence due to the angle deviation of θz being eliminated is calculated.

[Step S22]

In the case where the nozzle position having the coordinates $(x_i, y_i)$ for the nozzle number i is rotated from the state of θz=0 to a current position having θz=(−1)×θadj, the moving amount in the X direction is as below from Formula (11).

$$\Delta x_i=y_i\times\theta\text{adj} \quad \text{Formula (14)}$$

[Step S24]

At step S24, the calculation results in step S20 and step S22 are utilized to calculate the distance between the adjacent pixels accurately including the influence due to the angle deviation. First, the deposit displacement amounts d_adj_1, d_adj_2, d_adj_3 and so on are already calculated at step S20, with the influence due to the angle deviation being once eliminated. Then, the accurate line moving amounts Δx_1, Δx_2, Δx_3 and so on in the case of the angle deviation of θz (rotation by the angle θz of the entire head) are already calculated at step S22. Therefore, a distance P_i between the pixels of the adjacent nozzle numbers is as below.

$$\begin{aligned} P_i &= P_ideal + (d_adj_i + 1) + \Delta x_i + 1 - \{(d_adj_i) + \Delta x_i\} \\ &= 21.2 + (d_adj_i + 1) + \Delta x_i + 1 - \{(d_adj_i) + \Delta x_i\} \end{aligned} \quad \text{Formula (15)}$$

In this way, an accurate adjacent lines gap (that is, the distance between the adjacent pixels) can be calculated.

Figure 16:
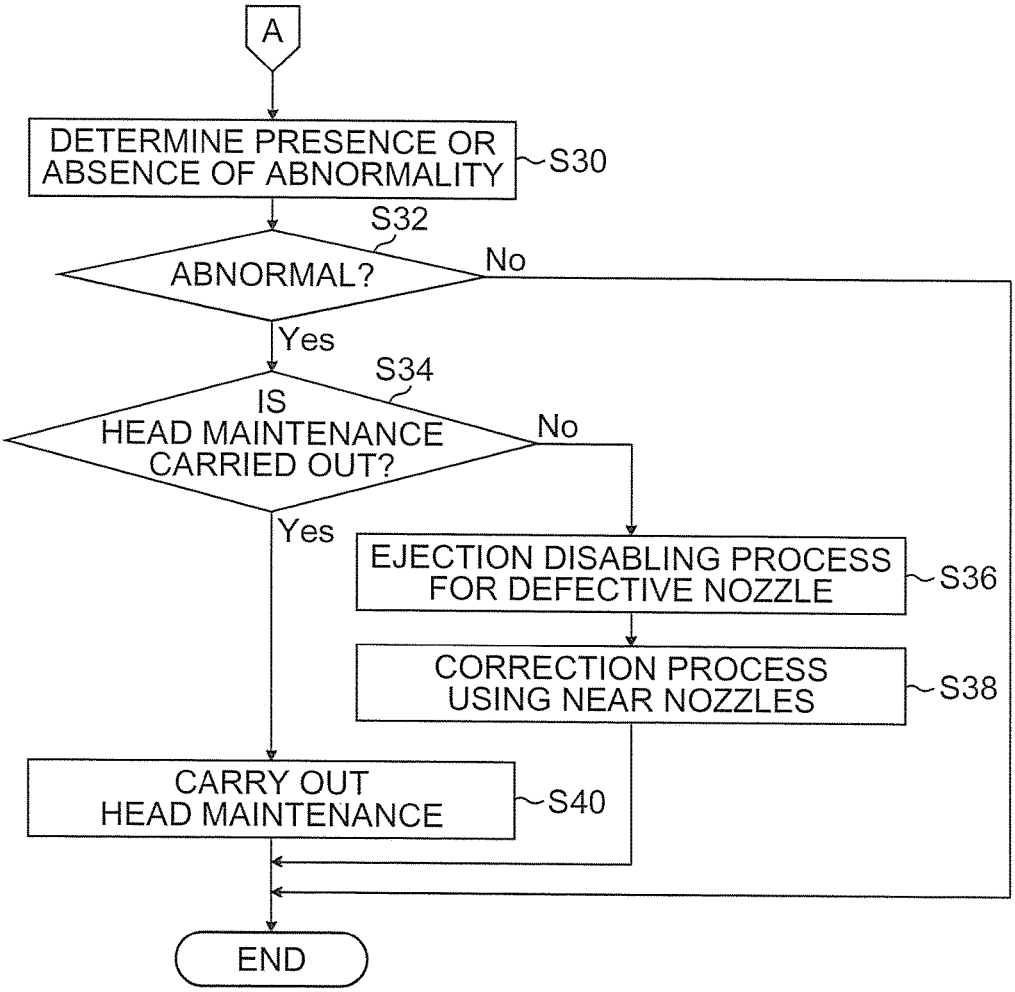
FIG. 16 is a flowchart showing a procedure of the inkjet head ejection performance evaluation method according to the embodiment.

After step S24 in FIG. 14, the process goes to step S30 in FIG. 16.

At step S30, presence or absence of abnormality is determined based on the calculation result in step S24. In other words, whether P_i calculated at step S24 is normal or abnormal is determined in a method as described in [Determination method to be normal or abnormal] set forth above. Then, if abnormality is determined, further, the defective nozzle is identified.

If the abnormality is determined at step S30, at subsequent step S32 in determination on abnormality, Yes is true, and the process goes to step S34. At step S34, whether or not the head maintenance is needed is determined. The determination on whether or not the head maintenance is needed is made in accordance with a prescribed determination criteria defined in advance. For example, if the number of portions where P_i is determined to be abnormal increases to exceed a prescribed amount, the head maintenance is needed.

At step S34, if the head maintenance is determined to not be needed, the process goes to step S36. At step S36, ejection disabling process for the defective nozzle is performed. The ejection disabling process is a process of forcibly making the defective nozzle unusable (disabling from ejection) so that the defective nozzle is not used for printing.

Further, in order to supplement the image defection involved by disabling the defective nozzle from ejection at step S36, a correction process is performed at step S38 using the near nozzles around the defective nozzle. The correction process at step S38 is a correction process of making the streak which is generated by disabling the defective nozzle from ejection to be indistinct, in which ink ejection amounts from the near nozzles are modified such that the near nozzles around the defective nozzle are made to carry out the droplet ejection in place of the defective nozzle.

At step S34, if the head maintenance is determined to be needed, the process goes to step S40 to carry out the head maintenance.

If No determination is made at step S32, the processes from step S34 to step S40 are skipped to end this flowchart. In addition, when the process at step S38 or the process at step S40 ends, this flowchart ends.

Modification Example

For step S24 in FIG. 14, in place of or in combination with the configuration of calculating the distance between the adjacent pixels as described above, also, the deposit displacement amount of each nozzle can be calculated.

Concretely, the deposit displacement amounts d_adj_1, d_adj 2, d_adj_3, and so on calculated in step S20, with the influence due to the angle deviation being once eliminated, may be added by the moving amounts of the nozzles Δx_1, Δx_2, Δx_3, and so on calculated in step S22 to obtain the deposit displacement amount in the state of the current angle deviation.

$$d_i = d_adj_i + \Delta x_i \quad \text{Formula (16)}$$

The deposit displacement amount $d_i$ calculated by this method may be compared with a predefined threshold and the like to determine whether it is normal or abnormal, and if it is determined to be abnormal, the correction may be done to make the streak to be indistinct or the head maintenance may be carried out.

[Description of Controlling System in Inkjet Print Device 10]

Figure 17:
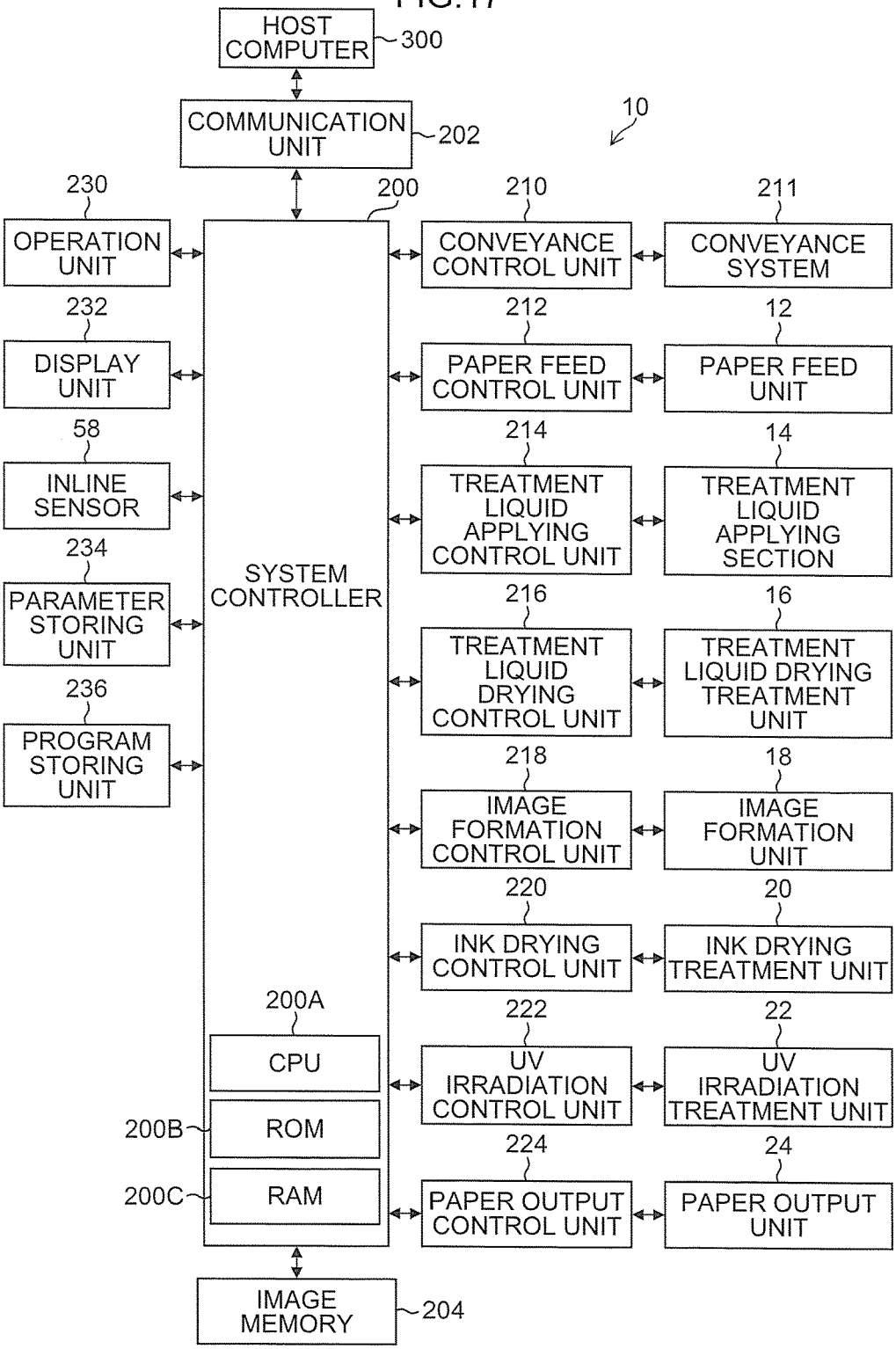
FIG. 17 is a block diagram showing a configuration of a controlling system in the inkjet print device.

FIG. 17 is a block diagram showing a configuration of a controlling system in the inkjet print device 10. The inkjet print device 10 includes a system controller 200, a communication unit 202, an image memory 204, a conveyance control unit 210, a paper feed control unit 212, a treatment liquid applying control unit 214, a treatment liquid drying control unit 216, an image formation control unit 218, an ink drying control unit 220, a UV irradiation control unit 222, a paper output control unit 224, an operation unit 230, and a display unit 232.

The system controller 200 functions as a controlling device collectively controlling the units in the inkjet print device 10 and functions as a calculation device performing various calculation processes. This system controller 200 has built in a CPU (Central Processing Unit) 200A, a ROM (Read Only Memory) 200B, and a RAM (Random Access Memory) 200C. The memory such as the ROM 200B and the RAM 200C may be provided outside the system controller 200.

The communication unit 202 includes a given communication interface, and transmits and receives data to and from a host computer 300 connected with the communication interface.

The image memory 204 functions as a transitory storage device for various pieces of data including the image data, from and into which image memory the data is read and written via the system controller 200. The image data taken in via the communication unit 202 from the host computer 300 is stored once in the image memory 204.

The conveyance control unit 210 controls an operation of a conveyance system 211 for the recording medium 28 in the inkjet print device 10 (conveyance of the recording medium 28 from the paper feed unit 12 to the paper output unit 24). The conveyance system 211 includes the treatment liquid applying drum 42 in the treatment liquid applying section 14, the treatment liquid drying drum 46 in the treatment liquid drying treatment unit 16, the image forming drum 52 in the image formation unit 18, and the chain gripper 64 which are illustrated in FIG. 1 (see FIG. 1).

The paper feed control unit 212 controls, in response to an instruction from the system controller 200, operations of the units in the paper feed unit 12 such as drive of the paper feed roller pair 34, and drive of the tape feeder 36A.

The treatment liquid applying control unit 214 controls, in response to an instruction from the system controller 200, operations of the units in the treatment liquid applying section 14 such as an operation of the treatment liquid applying unit 44 (application amount of the treatment liquid, the application timing and the like).

The treatment liquid drying control unit 216 controls, in response to an instruction from the system controller 200, operations of the units in the treatment liquid drying treatment unit 16. In other words, the treatment liquid drying control unit 216 controls operations of the treatment liquid drying treatment unit 50 such as a drying temperature, a flow rate of a dried gas, and an injection timing of the dried gas (see FIG. 1).

The image formation control unit 218 controls, in response to an instruction from the system controller 200, the ink ejection from the head units 56C, 56M, 56Y, and 56K in the image formation unit 18 (see FIG. 1).

The image formation control unit 218 includes an image processing unit (not shown) forming dot data from input image data, a waveform generating unit (not shown) generating a waveform of a drive voltage, a waveform storing unit (not shown) storing the waveform of the drive voltage, and a drive circuit (not shown) supplying to each of the head units 56C, 56M, 56Y, and 56K a drive voltage having a drive waveform depending on the dot data.

The image processing unit subjects the input image data to a color separation process of separating into each color of RGB, a color conversion process of converting RGB into CMYK, a correction process such as gamma correction and unevenness correction, and a half-tone process of converting M-valued data of each color into N-valued data of each color (M>N, M is an integer equal to or larger than 3, and N is an integer equal to or larger than 2).

The droplet ejection timing and ink droplets deposition amount at each pixel position are determined based on the dot data generated through the process by the image processing unit, the drive voltage and a drive signal (control signal determining the droplet ejection timing for each pixel) are generated depending on the droplet ejection timing and ink droplets deposition amount at each pixel position, this drive voltage is supplied to the head units 56C, 56M, 56Y, and 56K, and a dot is formed at each pixel position by an ink droplet ejected from each of the head units 56C, 56M, 56Y, and 56K.

The ink drying control unit 220 controls, in response to an instruction from the system controller 200, an operation of the ink drying treatment unit 20. In other words, the ink drying control unit 220 controls operations of the ink drying treatment unit 68 such as the drying temperature, the flow rate of a dried gas, and the injection timing of the dried gas (see FIG. 1).

The UV irradiation control unit 222 controls, in response to an instruction from the system controller 200, a light quantity of the ultraviolet rays (irradiation energy) from the UV irradiation treatment unit 22 and an irradiation timing of the ultraviolet rays.

The paper output control unit 224 controls, in response to an instruction from the system controller 200, an operation of the paper output unit 24 to stack the recording medium 28 on the paper output platform 76 (see FIG. 1).

The operation unit 230 includes an operational member such as an operation button, a keyboard and a touch panel, and transmits operational information input from the operational member to the system controller 200. The system controller 200 performs various processes in response to the operational information transmitted from the operation unit 230.

The display unit 232 includes a display device such as a liquid crystal panel, and displays, in response to an instruction from the system controller 200, information such as various pieces of setting information concerning the devices and abnormality information on the display device.

Detection signals (detected data) output from the inline sensor 58 are subjected to a process such as denoising and waveform shaping, and stored via the system controller 200 in a predetermined memory (e.g., RAM 200C).

A parameter storing unit 234 is a device storing therein various parameters used by the inkjet print device 10. The various parameters stored in the parameter storing unit 234 are read via the system controller 200 to be set for the units in the device 10.

A program storing unit 236 is a device storing therein programs which are used by the units in the inkjet print device 10. The various programs stored in the program storing unit 236 are read via the system controller 200 to be executed in the units in the device 10.

Figure 18:
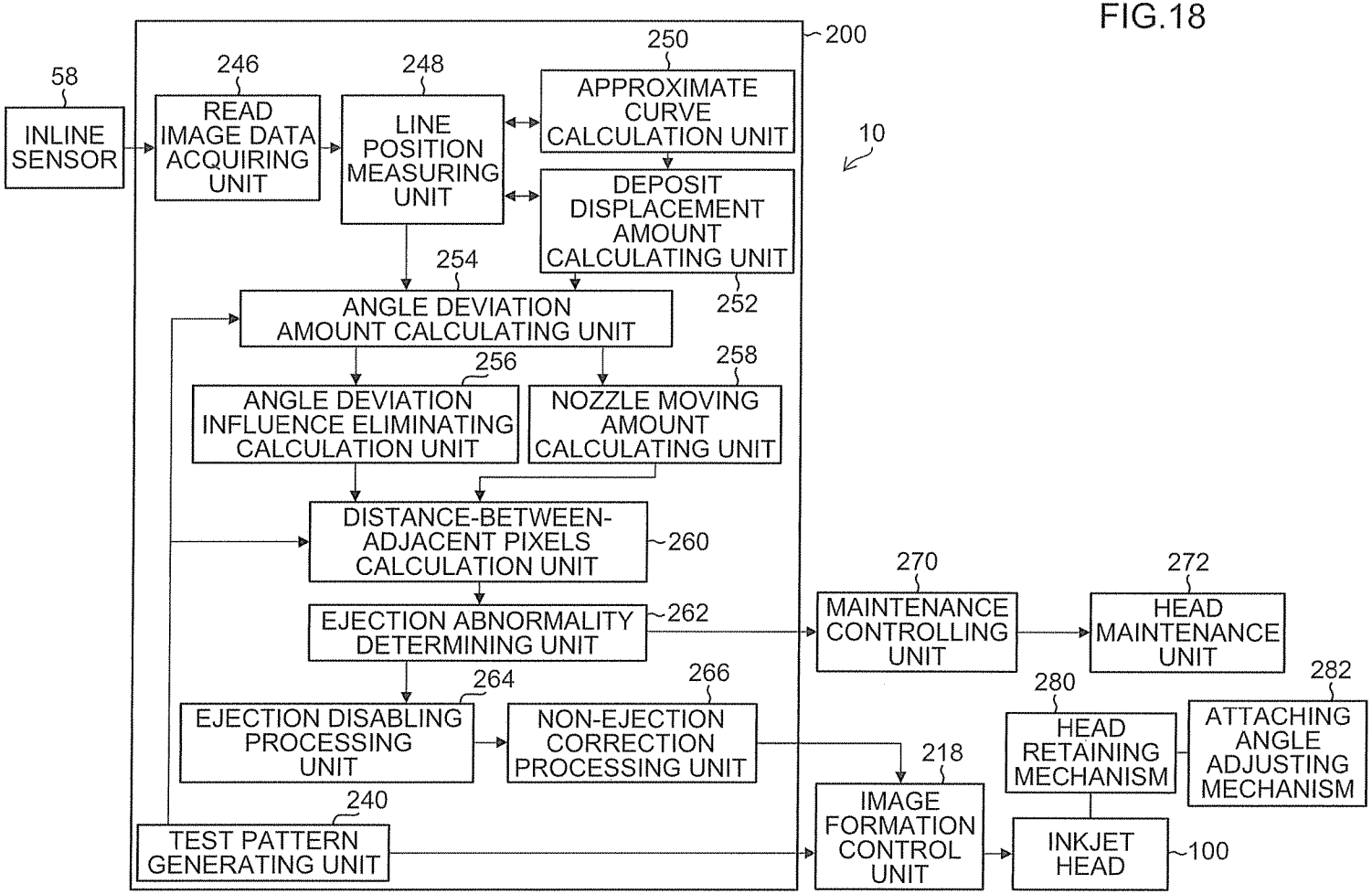
FIG. 18 is a block diagram showing a main part configuration of the controlling system in the inkjet print device.

FIG. 18 is a block diagram showing a main part of the controlling system in the inkjet print device according to the embodiment. In FIG. 18, the same component as in the configuration previously illustrated in FIG. 17 is designated by the same reference numeral, and the description thereof is omitted.

As shown in FIG. 18, the inkjet print device 10 includes a test pattern generating unit 240, a read image data acquiring unit 246, a line position measuring unit 248, an approximate curve calculation unit 250, a deposit displacement amount calculating unit 252, an angle deviation amount calculating unit 254, an angle deviation influence eliminating calculation unit 256, a nozzle moving amount calculating unit 258, a distance-between-adjacent pixels calculation unit 260, an ejection disabling processing unit 264, and a non-ejection correction processing unit 266. Processing functions of these units (240 to 266) can be implemented in combination of hardware circuits of the system controller 200 and the programs.

The test pattern generating unit 240 generates printing data of the nozzle state check pattern 130 and other test patterns. The data output from the test pattern generating unit 240 is transmitted to the image formation control unit 218 to control an ejection operation of the inkjet head 100 such that the nozzle state check pattern 130 is recorded on the recording medium 28. The test pattern generating unit 240 corresponds to an aspect of a "test pattern generating device". A combination of the test pattern generating unit 240 and the image formation control unit 218 corresponds to an aspect of a "test pattern output control device".

The read image data acquiring unit 246 is an interface part acquiring the read image data from the inline sensor 58. The system controller 200 acquires the read image data via the read image data acquiring unit 246.

The line position measuring unit 248 analyzes the read image acquired via the read image data acquiring unit 246 to measure the line positions of the lines 160 for each tier (for each line group), as for the line group of each of the divided tiers in the nozzle state check pattern 130. The line position measuring unit 248 performs the process of step S16 in FIG. 14. The line position measured by the line position measuring unit 248 corresponds to an aspect of the "first depositing position". The line position measuring unit 248 corresponds to an aspect of a "first calculation device".

The approximate curve calculation unit 250 carries out calculation for calculating the approximate curve based on data of the line position. The approximate curve calculation unit 250 carries out calculation for calculating the approximate curve from data of the measured line position for each of the divided tiers (line group) in the nozzle state check pattern 130. The approximate curve calculation unit 250 corresponds to an aspect of an "approximate curve calculation device".

The deposit displacement amount calculating unit 252 calculates the deposit displacement amount from the approximate curve calculated by the approximate curve calculation unit 250 and the data of the line position. The deposit displacement amount calculated from the data of the line position measured by the line position measuring unit 248 and the approximate curve corresponds to an aspect of a "first deposit displacement amount".

The angle deviation amount calculating unit 254 calculates the angle deviation amount of the inkjet head 100 with respect to the reference attaching angle based on the line position calculated by the line position measuring unit 248 and the pattern information of the nozzle state check pattern 130. The pattern information of the nozzle state check pattern 130 includes information concerning the number of divisions (the number of the tiers) or the nozzle interval in the line group of each tier.

The angle deviation amount calculating unit 254 performs the process of step S18 in FIG. 14. The angle deviation amount calculating unit 254 corresponds to an aspect of an "angle deviation amount calculating device".

The angle deviation amount is an angle in the rotation direction about an axis in the Z direction as the rotation center. The angle deviation amount calculating unit 254 uses a calculatory moved position in a case where the position of the line is moved in a rotation direction of θz by the angle $\theta_r$ to calculate the calculatory deposit displacement amount in the case of the rotation by the angle $\theta_r$, and calculate the angle θadj with the standard deviation of the calculatory deposit displacement amount being minimum (see FIG. 15).

The angle deviation influence eliminating calculation unit 256 performs the process of step S20 in FIG. 14. The angle deviation influence eliminating calculation unit 256 carries out calculation for calculating at least one of the depositing position for each nozzle 110 (corresponding to an aspect of a "second depositing position") and deposit displacement amount for each nozzle 110 (corresponding to an aspect of a "second deposit displacement amount") in which the influence due to the angle deviation caused by the angle deviation amount is eliminated from at least one of the line position for each nozzle 110 calculated by the line position measuring unit 248 and the deposit displacement amount for each nozzle 110 calculated based on the data of the line position. The angle deviation influence eliminating calculation unit 256 corresponds to an aspect of a "second calculation device".

The nozzle moving amount calculating unit 258 performs the process of step S22 in FIG. 14. The nozzle moving amount calculating unit 258 calculates the moving amount caused by the rotation of the angle deviation amount from a reference position of the nozzle 110 at the reference attaching angle (θz=0) up to a current nozzle position based on the angle deviation amount calculated by the angle deviation amount calculating unit 254. The nozzle moving amount calculating unit 258 corresponds to an aspect of a "third calculation device".

The distance-between-adjacent pixels calculation unit 260 performs the process of step S24 in FIG. 14. The distance-between-adjacent pixels calculation unit 260 uses the calculation results by the angle deviation influence eliminating calculation unit 256 and the nozzle moving amount calculating unit 258 to calculate the distance between the adjacent pixels including the influence due to the angle deviation. The distance-between-adjacent pixels calculation unit 260 corresponds to an aspect of a "fourth calculation device".

In place of or in combination with the distance-between-adjacent pixels calculation unit 260, a calculation unit may be included which uses the calculation results by the angle deviation influence eliminating calculation unit 256 and the nozzle moving amount calculating unit 258 to calculate an accurate deposit displacement amount for each nozzle 110 including the influence due to the angle deviation (corresponding to an aspect of a "third deposit displacement amount").

An ejection abnormality determining unit 262 performs the process of steps S30 to S34 in FIG. 16. The ejection abnormality determining unit 262 corresponds to an aspect of a "determining device".

The ejection disabling processing unit 264 performs the process of step S36 in FIG. 16. The ejection disabling processing unit 264 performs the ejection disabling process of disabling the defective nozzle from ejection, for which the distance between the adjacent pixels calculated by the distance-between-adjacent pixels calculation unit 260 is out of a prescribed acceptable range. Further, the ejection disabling processing unit 264 may be in a form of performing the ejection disabling process of disabling the defective nozzle from ejection, the deposit displacement amount for each nozzle 110 of which defective nozzle including the influence due to the angle deviation (third deposit displacement amount) exceeds a threshold. The ejection disabling processing unit 264 corresponds to an aspect of an "ejection disabling processing device".

The non-ejection correction processing unit 266 performs the process of step S38 in FIG. 16. The non-ejection correction processing unit 266 performs an image correcting process such that the image defection (the streak) involved by disabling the defective nozzle from ejection is made to be indistinct by use of the near nozzles around the defective nozzle. The non-ejection correction processing unit 266 corresponds to an aspect of a "correction processing device".

The inkjet print device 10 includes a maintenance controlling unit 270 and a head maintenance unit 272. The maintenance controlling unit 270 controls an operation of the head maintenance. The head maintenance unit 272 may be configured to include a cleaning device wiping the nozzle surface 102 of the inkjet head 100 and a sucking device sucking the ink within the nozzles 110. The maintenance controlling unit 270 performs the process of step S40 in FIG. 16.

The inkjet print device 10 also includes a head retaining mechanism 280 and an attaching angle adjusting mechanism 282. The head retaining mechanism 280 is a retaining device which retains the inkjet head 100 at the print position where to face the image forming drum 52. The inkjet head 100 is retained at a predetermined attaching angle by the head retaining mechanism 280. The head retaining mechanism 280 is provided with the attaching angle adjusting mechanism 282 for adjusting the attaching angle of the inkjet head 100. The attaching angle adjusting mechanism 282 may be provided to the inkjet heads 100 constituting the head unit 56 or as an adjusting device which adjusts the attaching angle of the head unit 56, or a combination of these.

[Ejection Method]

Although a detailed configuration of the inkjet head 100 is not shown, an ejector in the inkjet head 100 includes the nozzle 110 ejecting a liquid, a pressure chamber communicating with the nozzle 110, and an ejection energy generating element giving the liquid within the pressure chamber an ejection energy. In the ejection method for ejecting the liquid droplets from the nozzle 110 in the ejector, a generating device which generates the ejection energy is not limited to a piezo element, and various ejection energy generating elements may be used such as a heater element or a static actuator. For example, a method may be used in which a pressure of film boiling by way of heating the liquid by the heater element is used to eject the liquid droplets. A corresponding ejection energy generating element is provided in a flow channel structure in accordance with the ejection method of a liquid ejection head.

[Nozzle Array]

The nozzle array form of the inkjet head 100 is not limited to the form illustrated in FIG. 3 and FIG. 4, and various array forms may be used. In consideration the problem for the invention to solve, it is preferable that the inkjet head 100 is configured to have a nozzle array in a matrix in which the plural nozzles are arrayed in three or more alignments in the first direction that is a direction of the relative movement.

The above description is given of one inkjet head 100 constituting the head unit 56, but the description of the inkjet head 100 can be similarly applied to the nozzle array of the entire head unit 56.

Advantage of Embodiments

According to the embodiments of the present invention, the ejection condition of each nozzle can be evaluated accurately including the influence due to the angle deviation of the inkjet head. This makes it possible to perform the high accurate abnormality determination and correction process.

Other Modification Example

The embodiment described above shows the configuration in which the recording medium is conveyed with respect to the stopped inkjet head to cause the relative movement between the inkjet head and the recording medium, but in implementing the present invention, the inkjet head may be configured to be moved with respect to the stopped recording medium. Note that the single-pass printing full-line type heads are usually arranged along a direction perpendicular to the conveying direction of the recording medium, but the inkjet heads may be arranged along an inclined direction at an angle to the direction perpendicular to the conveying direction in an aspect.

The embodiment described above shows an example of the full-line type inkjet print device 10, but in implementing the present invention, may be applied to an inkjet print device with a serial head in which print is performed on an entire surface of the recording medium by repeating such a series of operations that a shorter length head not reaching the width of the recording medium is made to scan in the width direction of the recording medium for printing in the same direction, the recording medium is moved by a certain amount, and the next area is printed in the width direction of the recording medium.

In a case where the inkjet head carries out the reciprocating scanning in this way to perform print, a carriage moving the inkjet head corresponds to an aspect of a "relative moving device" and a moving direction (scanning direction) of the inkjet head corresponds to the "first direction".

[Combination of Controlling Examples]

The configuration described in the above embodiments or the matter described in the modification example may be appropriately combined to be used and a part of the matters may be replaced.

[Conveyance Device for Recording Medium]

A conveyance device which conveys the recording medium 28 is not limited to the drum conveyance method illustrated in FIG. 1, and various forms may be used such at a belt conveyance method, a nip conveyance method, a chain conveyance method, and a pallet conveyance method, and these methods may be combined.

[Terms]

The term "perpendicular" or "vertical" herein includes, of aspects of crossing at an angle less than 90° or more than 90°, an aspect of generating an action and effect the same as a case of crossing at substantially an angle 90°.

The term "recording medium" means a "medium" used for printing. The recording medium is equivalent to terms such as a print paper sheet, a recording paper sheet, a paper sheet, a printing medium, a printed medium, a recorded medium, an image formation medium, an image formed medium, an image receiving medium, and an ejection deposited medium. A material, shape or the like of the recording medium is not specifically limited, and a resin sheet, a film, fabric, a non-woven fabric and other materials may be used besides the paper material, and various forms may be used such as a continuous paper, a cut sheet of paper sheet (cut paper sheet) and a seal paper sheet.

The term "image" is assumed to be widely construed, including a color image, a bitonal image, a single color image, a gradation image, and an even density (solid color) image. The term "image" is not limited to a photographed image, and is used as an encompassing term, including a pictural design, a character, a sign, a drawing line, a mosaic pattern, a pattern differently colored, and other various patterns, or a combination of these. The term "print" includes a concept of terms such as typing print, recording an image, image formation, drawing, and printing.

The term "print device" is equivalent to terms such as printing machine, printer, image recording device, drawing device, and image formation device.

In the embodiments of the present invention described above, the configuration requirements may be appropriately changed, added or deleted without departing from the scope of the present invention. The present invention is not limited to the above described embodiments, but may be variously modified by a person having ordinary skill in the art within the technical idea of the present invention.

What is claimed is:

1. An inkjet print device comprising:

an inkjet head having a plurality of nozzles arrayed in a matrix;

a controller, configured to control the inkjet head to record a test pattern for examining an ejection condition for each of the nozzles on a recording medium; and an image sensor, configured to optically read an image of the test pattern recorded on the recording medium, wherein the controller is further configured to:

measure a first depositing position for each of the nozzles from the read image of the test pattern read by the image reading device;

calculate an angle deviation amount of the inkjet head with respect to a reference attaching angle based on the first depositing position measured by the first calculation device and pattern information of the test pattern;

calculate at least one of a second depositing position for each of the nozzles and a second deposit displacement amount for each of the nozzles due to angle deviation caused by the angle deviation amount of the inkjet head is eliminated from at least one of the first depositing position for each of the nozzles measured by the first calculation device and a first deposit displacement amount for each of the nozzles calculated based on data of the first depositing position;

calculate a moving amount of each of the nozzles caused by rotation of the angle deviation amount from a reference position of the nozzle at the reference attaching angle up to a current nozzle position based on the angle deviation amount calculated by the angle deviation amount calculating device; and use calculation results to calculate at least one of a distance between adjacent pixels due to the angle deviation and a third deposit displacement amount for each of the nozzles due to the angle deviation, wherein the calculation results are at least one of the second depositing position for each of the nozzles and the second deposit displacement amount for each of the nozzles, and the moving amount of each of the nozzles, wherein the controller is configured to:

calculate the distance between the adjacent pixels due to the angle deviation, disable a defective nozzle from ejection, for which the distance between the adjacent pixels calculated by the fourth calculation device is out of a prescribed acceptable range, and perform image correction to supplement an image defection which is involved by disabling the defective nozzle from ejection by use of near nozzles around the defective nozzle.

2. The inkjet print device according to claim 1, further comprising image drum, configured to cause relative movement between the inkjet head and the recording medium, wherein the inkjet head has a nozzle array in a matrix in which the plurality of nozzles are arrayed in three or more alignments in a first direction that is a direction of the relative movement.

3. The inkjet print device according to claim 2, wherein the test pattern is a line pattern for recording a line for each of the nozzles in the first direction, and is divided into two or more line groups to be recorded on the recording medium, and wherein the controller is further configured to generate data of the test pattern and control ejection from the inkjet head based on the data of the test pattern.

4. The inkjet print device according to claim 3, wherein the controller is further configured to measure a position of the line as the first depositing position for each of the divided line groups.

5. The inkjet print device according to claim 4, wherein the controller is further configured to:

calculate an approximate curve from the data of the first depositing position measured for each of the divided line groups; and calculate the first deposit displacement amount from the approximate curve and the data of the first depositing position.

6. The inkjet print device according to claim 5, wherein the angle deviation amount is an angle in a rotation direction about an axis as a rotation center which is in a third direction orthogonal to a second direction and orthogonal to the first direction, the second direction being a width direction of the recording medium perpendicular to the first direction, and wherein the controller is configured to use a calculatory moved position to calculate a calculatory deposit displacement amount and calculate an angle θadj with a standard deviation of the calculatory deposit displacement amount being minimum, wherein the calculatory moved position is a position to which the line for each of the nozzles is moved in the rotation direction by an angle $\theta_r$, and wherein the calculatory deposit displacement amount is a displacement amount of each of the nozzles rotated by the angle θr.

7. The inkjet print device according to claim 6, wherein the controller is configured to calculate the angle θadj for each of the divided line groups to calculate an average value of the angle θadj calculated for the respective line groups.

8. The inkjet print device according to claim 1, wherein the controller is further configured to determine presence or absence of abnormality based on a calculation result, wherein at least an operation of correction process or head maintenance is performed in a case where ejection abnormality is determined.

9. An inkjet head ejection performance evaluation method comprising:

a test pattern outputting step of, in an inkjet head having therein a plurality of nozzles arrayed in a matrix, recording a test pattern on a recording medium by the inkjet head, the test pattern being for examining an ejection condition for each of the nozzles;

an image reading step of optically reading an image of the test pattern recorded on the recording medium;

a first calculation step of measuring a first depositing position for each of the nozzles from the read image of the test pattern read in the image reading step;

an angle deviation amount calculating step of calculating an angle deviation amount of the inkjet head with respect to a reference attaching angle based on the first depositing position measured in the first calculation step and pattern information of the test pattern;

a second calculation step of calculating at least one of a second depositing position for each of the nozzles and a second deposit displacement amount for each of the nozzles due to angle deviation caused by the angle deviation amount of the inkjet head is eliminated from at least one of the first depositing position for each of the nozzles measured in the first calculation step and a first deposit displacement amount for each of the nozzles calculated based on data of the first depositing position;

a third calculation step of calculating a moving amount of each of the nozzles caused by rotation of the angle deviation amount from a reference position of the nozzle at the reference attaching angle up to a current nozzle position based on the angle deviation amount calculated in the angle deviation amount calculating step; and a fourth calculation step of using calculation results in the second calculation step and the third calculation step to calculate at least one of a distance between adjacent pixels due to the angle deviation and a third deposit displacement amount for each of the nozzles due to the angle deviation.

10. An inkjet print device comprising:

an inkjet head having a plurality of nozzles arrayed in a matrix;

a controller, configured to control the inkjet head to record a test pattern for examining an ejection condition for each of the nozzles on a recording medium; and an image sensor, configured to optically read an image of the test pattern recorded on the recording medium, wherein the controller is further configured to:

measure a first depositing position for each of the nozzles from the read image of the test pattern read by the image reading device;

calculate an angle deviation amount of the inkjet head with respect to a reference attaching angle based on the first depositing position measured by the first calculation device and pattern information of the test pattern;

calculate at least one of a second depositing position for each of the nozzles and a second deposit displacement amount for each of the nozzles due to angle deviation caused by the angle deviation amount of the inkjet head is eliminated from at least one of the first depositing position for each of the nozzles measured by the first calculation device and a first deposit displacement amount for each of the nozzles calculated based on data of the first depositing position;

calculate a moving amount of each of the nozzles caused by rotation of the angle deviation amount from a reference position of the nozzle at the reference attaching angle up to a current nozzle position based on the angle deviation amount calculated by the angle deviation amount calculating device; and use calculation results to calculate at least one of a distance between adjacent pixels due to the angle deviation and a third deposit displacement amount for each of the nozzles due to the angle deviation, wherein the calculation results are at least one of the second depositing position for each of the nozzles and the second deposit displacement amount for each of the nozzles, and the moving amount of each of the nozzles, wherein the controller is further configured to:

calculate the third deposit displacement amount of the nozzle due to the angle deviation;

disable a defective nozzle from ejection, the third deposit displacement amount of the defective nozzle exceeding a threshold; and perform image correction to supplement an image defection which is involved by disabling the defective nozzle from ejection by use of near nozzles around the defective nozzle.

11. The inkjet print device according to claim 10, further comprising an image drum, configured to cause relative movement between the inkjet head and the recording medium, wherein the inkjet head has a nozzle array in a matrix in which the plurality of nozzles are arrayed in three or more alignments in a first direction that is a direction of the relative movement.

12. The inkjet print device according to claim 11, wherein the test pattern is a line pattern for recording a line for each of the nozzles in the first direction, and is divided into two or more line groups to be recorded on the recording medium, and wherein the controller is further configured to generate data of the test pattern and control ejection from the inkjet head based on the data of the test pattern.

13. The inkjet print device according to claim 12, wherein the controller is further configured to measure a position of the line as the first depositing position for each of the divided line groups.

14. The inkjet print device according to claim 13, wherein the controller is further configured to:

calculate an approximate curve from the data of the first depositing position measured for each of the divided line groups; and calculate the first deposit displacement amount from the approximate curve and the data of the first depositing position.

15. The inkjet print device according to claim 14, wherein the angle deviation amount is an angle in a rotation direction about an axis as a rotation center which is in a third direction orthogonal to a second direction and orthogonal to the first direction, the second direction being a width direction of the recording medium perpendicular to the first direction, and wherein the controller is configured to use a calculatory moved position to calculate a calculatory deposit displacement amount and calculate an angle θadj with a standard deviation of the calculatory deposit displacement amount being minimum, wherein the calculatory moved position is a position to which the line for each of the nozzles is moved in the rotation direction by an angle θr, and wherein the calculatory deposit displacement amount is a displacement amount of each of the nozzles rotated by the angle θr.

16. The inkjet print device according to claim 15, wherein the controller is configured to calculate the angle θadj for each of the divided line groups to calculate an average value of the angle θadj calculated for the respective line groups.

17. The inkjet print device according to claim 10, wherein the controller is further configured to determine presence or absence of abnormality based on a calculation result, wherein at least an operation of correction process or head maintenance is performed in a case where ejection abnormality is determined.

18. An inkjet print device comprising:

an inkjet head having a plurality of nozzles arrayed in a matrix;

a controller, configured to control the inkjet head to record a test pattern for examining an ejection condition for each of the nozzles on a recording medium; and an image drum, configured to cause relative movement between the inkjet head and the recording medium, wherein the nozzles are arrayed in three or more alignments in a first direction that is a direction of the relative movement;

an image sensor, configured to optically read an image of the test pattern recorded on the recording medium, wherein the controller is further configured to:

measure a first depositing position for each of the nozzles from the read image of the test pattern read by the image reading device;

calculate an angle deviation amount of the inkjet head with respect to a reference attaching angle based on the first depositing position measured by the first calculation device and pattern information of the test pattern;

calculate at least one of a second depositing position for each of the nozzles and a second deposit displacement amount for each of the nozzles due to angle deviation caused by the angle deviation amount of the inkjet head is eliminated from at least one of the first depositing position for each of the nozzles measured by the first calculation device and a first deposit displacement amount for each of the nozzles calculated based on data of the first depositing position;

calculate a moving amount of each of the nozzles caused by rotation of the angle deviation amount from a reference position of the nozzle at the reference attaching angle up to a current nozzle position based on the angle deviation amount calculated by the angle deviation amount calculating device; and use calculation results to calculate at least one of a distance between adjacent pixels due to the angle deviation and a third deposit displacement amount for each of the nozzles due to the angle deviation, wherein the calculation results are at least one of the second depositing position for each of the nozzles and the second deposit displacement amount for each of the nozzles, and the moving amount of each of the nozzles, wherein the test pattern is a line pattern for recording a line for each of the nozzles in the first direction, and is divided into two or more line groups to be recorded on the recording medium, and wherein the controller is further configured to generate data of the test pattern and control ejection from the inkjet head based on the data of the test pattern, wherein the controller is further configured to measure a position of the line as the first depositing position for each of the divided line groups, calculate an approximate curve from the data of the first depositing position measured for each of the divided line groups, and calculate the first deposit displacement amount from the approximate curve and the data of the first depositing position, wherein the angle deviation amount is an angle in a rotation direction about an axis as a rotation center which is in a third direction orthogonal to a second direction and orthogonal to the first direction, the second direction being a width direction of the recording medium perpendicular to the first direction, and the controller is configured to use a calculatory moved position to calculate a calculatory deposit displacement amount and calculate an angle θadj with a standard deviation of the calculatory deposit displacement amount being minimum, wherein the calculatory moved position is a position to which the line for each of the nozzles is moved in the rotation direction by an angle θr, and wherein the calculatory deposit displacement amount is a displacement amount of each of the nozzles rotated by the angle θr.

19. The inkjet print device according to claim 18, wherein the controller is configured to calculate the angle θadj for each of the divided line groups to calculate an average value of the angle θadj calculated for the respective line groups.

20. The inkjet print device according to claim 19, wherein the controller is further configured to determine presence or absence of abnormality based on a calculation result, wherein at least an operation of correction process or head maintenance is performed in a case where ejection abnormality is determined.

* * * * *